US011920611B2

(12) United States Patent
Kim et al.

(10) Patent No.: US 11,920,611 B2
(45) Date of Patent: Mar. 5, 2024

(54) BLOWER

(71) Applicant: LG ELECTRONICS INC., Seoul (KR)

(72) Inventors: Yongmin Kim, Seoul (KR); Hyungho Park, Seoul (KR); Hoojin Kim, Seoul (KR); Jaehyeon Kim, Seoul (KR); Kidong Kim, Seoul (KR); Seokho Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1 day.

(21) Appl. No.: 17/909,858

(22) PCT Filed: Mar. 5, 2021

(86) PCT No.: PCT/KR2021/002786

§ 371 (c)(1),
(2) Date: Sep. 7, 2022

(87) PCT Pub. No.: WO2021/182809

PCT Pub. Date: Sep. 16, 2021

(65) Prior Publication Data

US 2023/0102734 A1 Mar. 30, 2023

(30) Foreign Application Priority Data

Mar. 11, 2020 (KR) ..... 10-2020-0030013
Mar. 11, 2020 (KR) ..... 10-2020-0030014

(51) Int. Cl.
*F04D 29/56* (2006.01)
*F04D 19/00* (2006.01)
*F04D 29/70* (2006.01)

(52) U.S. Cl.
CPC ..... *F04D 29/563* (2013.01); *F04D 19/002* (2013.01); *F04D 29/703* (2013.01)

(58) Field of Classification Search
CPC .... F04D 29/563; F04D 19/002; F04D 29/703; F04D 25/14; F04D 27/002; F04D 27/003;
(Continued)

(56) References Cited

U.S. PATENT DOCUMENTS 10,184,495 B2 * 1/2019 Iyer ..... F04D 29/5826

FOREIGN PATENT DOCUMENTS

CN 104863871 8/2015
JP 2013-015114 1/2013
(Continued)

OTHER PUBLICATIONS

International Search Report dated Jun. 24, 2021 issued in Application No. PCT/KR2021/002786.

*Primary Examiner* — Aaron R Eastman
(74) *Attorney, Agent, or Firm* — KED & ASSOCIATES

(57) ABSTRACT

A blower is disclosed. The blower of the present disclosure comprises: a fan generating flow of air; a lower body providing an internal space in which the fan is installed, and having a suction hole through which air passes; an upper body being an upper body, which is installed over the lower body and forms a channel that communicates with the internal space of the lower body, and having a space formed through the upper body in a front-rear direction; a slit formed to pass through the upper body and discharging air flowing through the channel of the upper body to an outside of the upper body; and a vane or a door movably installed inside the upper body, and adjusting a flow direction of the air passing through the slit.

20 Claims, 12 Drawing Sheets

(58) Field of Classification Search
CPC ..... F04D 29/602; F04D 17/06; F04D 25/08;
F04D 29/542; F04F 5/16; F04F 5/461
See application file for complete search history.

(56) References Cited

FOREIGN PATENT DOCUMENTS

| | | |
|---|---|---|
| JP | 2016-000967 | 1/2016 |
| JP | 2019-060294 | 4/2019 |
| JP | 2019-100341 | 6/2019 |
| KR | 10-2011-0099318 | 9/2011 |
| KR | 10-2011-0100274 | 9/2011 |
| KR | 10-1472758 | 12/2014 |
| KR | 10-2018-0032438 | 3/2018 |
| KR | 10-2019-0015325 | 2/2019 |
| KR | 10-2019-0025443 | 3/2019 |

* cited by examiner

BLOWER

CROSS-REFERENCE TO RELATED PATENT APPLICATIONS

This application is a U.S. National Stage Application under 35 U.S.C. § 371 of PCT Application No. PCT/KR2021/002786, filed Mar. 5, 2021, which claims priority to Korean Patent Application Nos. 10-2020-0030013 and 10-2020-0030014, both filed Mar. 11, 2020, whose entire disclosures are hereby incorporated by reference.

TECHNICAL FIELD

The present disclosure relates to a blower. In particular, the present disclosure relates to a blower that can variously adjust a blowing direction or a blowing range.

BACKGROUND ART

A blower can circulate air or generate airflow toward a user in an interior by generating flow of air. Recently, many researches are conducted about the air discharge structure of a blower that can make a user feel pleasant.

In relation to this, Korean Patent Application Publication Nos. KR2011-0099318, KR2011-0100274, KR2019-0015325, and KR2019-0025443 disclose a blowing device or a fan that blows air using Coanda effect.

Meanwhile, it was required to move or rotate a blowing device itself in order to adjust a blowing direction or a blowing range in the related art. Accordingly, there was a problem that it is difficult to effectively adjust a blowing direction or a blowing range and excessive power is consumed.

DISCLOSURE

Technical Problem

An object of the present disclosure is to solve the problems described above and other problems.

Another object may be to provide a blower that can blow air using Coanda effect.

Another object of the present disclosure may be to provide a blower capable of adjusting a flow direction of air passing through a slit to form airflow of direct wind or indirect wind.

Another object of the present disclosure may be to provide a vane that is movably installed inside a blower to adjust a flow direction of air passing through a slit.

Another object of the present disclosure may be to provide a door that is movably installed inside a blower to adjust a flow direction of air passing through a slit or open and close the slit.

Another object of the present disclosure may be to provide a movable vane and door inside a blower while being hidden from a user's gaze.

Another object may be to provide various examples of drive mechanisms for moving a vane and a door.

Technical Solution

According to an aspect of the present disclosure for achieving the objects described above, there is provided a blower includes: a fan generating flow of air; a lower body providing an internal space in which the fan is installed, and having a suction hole through which air passes; an upper body being an upper body, which is installed over the lower body and forms a channel that communicates with the internal space of the lower body, and having a space formed through the upper body in a front-rear direction; a slit formed to pass through the upper body and discharging air flowing through the channel of the upper body to an outside of the upper body; and a vane or a door movably installed inside the upper body, and adjusting a flow direction of the air passing through the slit.

Further, according to another aspect of the present disclosure, the vane may be installed pivotally or slidably inside the upper body, and a space between the vane and an inner surface of the upper body may vary in response to rotation or sliding of the vane, and guide the air flowing through the channel of the upper body to the slit.

Further, according to another aspect of the present disclosure, the door may be rotatably and movably installed inside the upper body to open and close the slit or to adjust the flow direction of air passing through the slit.

Further, according to another aspect of the present disclosure, the upper body may further include: a first upper body forming a first channel that communicates with the internal space of the lower body; and a second upper body spaced apart from the first upper body and formed a second channel that communicates with the internal space of the lower body, the space may be formed between the first upper body and the second upper body, and the slit may include: a first slit formed to pass through the first upper body; and a second slit formed to pass through the second upper body.

Further, according to another aspect of the present disclosure, the first upper body may include: a first inner panel facing the space; and a first outer panel facing the first inner panel and having the first slit formed therein, and the second upper body includes: a second inner panel facing the space; and a second outer panel facing the first inner panel and having the first slit formed therein.

Further, according to another aspect of the present disclosure, the first inner panel may be in contact with the first outer panel to form a front end and a rear end of the first upper body, the second inner panel may be in contact with the second outer panel to form a front end and a rear end of the second upper body, the first slit may be adjacent to the front end of the first upper body, and the second slit may be adjacent to the front end of the second upper body.

Further, according to another aspect of the present disclosure, the first upper body may be spaced left apart from the second upper body, a surface of the first inner panel may be convex to the right, a surface of the first outer panel may be convex to the right, a surface of the second inner panel may be convex to the left, a surface of the second outer panel may be convex to the right, a curvature of the surface of the first outer panel may be greater than that of the surface of the first inner panel, and a curvature of the surface of the second outer panel may be greater than that of the surface of the second inner panel.

Further, according to another aspect of the present disclosure, the blower may further include: a first rib installed inside the first upper body to guide the air in the first channel to the first slit; and a second rib installed inside the second upper body to guide the air in the second channel to the second slit.

Further, according to another aspect of the present disclosure, the vane may further include: a first vane disposed inside the first upper body and adjacent to the first slit; and a second vane disposed on the inside of the second upper body and adjacent to the second slit, and the blower further include: a first vane assembly installed inside the first upper body and having the first vane and a first driver providing power to the first vane; a second vane assembly installed inside the first upper body and having the first vane and a first driver providing power to the first vane; and a controller electrically connected to the first vane assembly and the second vane assembly to control operations of the first vane assembly and the second vane assembly.

Further, according to another aspect of the present disclosure, the first vane assembly and the second vane assembly may be left-right symmetric.

Further, according to another aspect of the present disclosure, the first slit may be formed between a first inner edge adjacent to a front end of the first upper body and a first outer edge facing the first inner edge of the first outer panel, and the first vane may be elongated along the first slit and is movable in a direction closer to or away from an inner surface of the first inner panel.

Further, according to another aspect of the present disclosure, the first vane may include: a first guide surface forming one surface of the first vane and facing the inner surface of the first inner panel but spaced apart from the first inner panel; and a first seating surface forming the other surface of the first vane and facing an inner surface of the first outer panel, and the first vane may be pivotably coupled to the first outer edge at a point where the first guide surface and the first seating surface meet.

Further, according to another aspect of the present disclosure, the first inner panel may be convex in a direction toward the space, the first guide surface may have a shape corresponding to the inner surface of the first inner panel, the first seating surface may have a shape corresponding to the inner surface of the first outer panel, and the first vane may receive power from the first driver and pivot about the first outer edge to be closer to or away from the inner surface of the first inner panel.

Further, according to another aspect of the present disclosure, the first vane may include: a first guide surface forming one surface of the first vane and facing the inner surface of the first inner panel but spaced apart from the first inner panel; and a first sliding surface forming the other surface of the first vane and facing the inner surface of the first outer panel, and the first vane may be slidable in a direction closer to or away from the first outer edge.

Further, according to another aspect of the present disclosure, the first inner panel may be convex in a direction toward the space, the first guide surface may have a shape corresponding to the inner surface of the first inner panel, the first sliding surface may have a shape corresponding to the inner surface of the first outer panel, and the first vane may receive power from the first driver and slide along the inner surface of the first outer panel to be closer to or away from the inner surface of the first inner panel.

Further, according to another aspect of the present disclosure, the door may further include: a first door rotatably and movably installed on the first upper body and opening and closing the first slit; and a second door rotatably and movably installed on the second upper body and opening and closing the second slit, and the blower may further include: a first door assembly installed inside the first upper body and having the first door and a first door driver providing power to the first door; and a second door assembly installed inside the second upper body and having the second door and a second door driver providing power to the second door; and a controller electrically connected to the first door assembly and the second door assembly and controlling operations of the first door assembly and the second door assembly.

Further, according to another aspect of the present disclosure, the first door assembly and the second door assembly may be left-right symmetric.

Further, according to another aspect of the present disclosure, the first slit may be formed between a first inner edge adjacent to a front end of the first upper body and a first outer edge toward the first inner edge of the first outer panel, the first door may be elongated along the first slit, and an area of the first door may be larger than a size of the first slit.

Further, according to another aspect of the present disclosure, the first door may be disposed in parallel with the first outer panel to close the first slit, at a first position, disposed inside the first upper body to open the first slit and disposed in a direction crossing the first inner edge, at a second position, and disposed inside the first upper body to open the first slit and disposed in a direction crossing the first outer edge, at a third position, the first door positioned at the second position may be disposed closer to the first inner panel toward the front, and the first door positioned at the third position may be disposed closer to the first outer panel toward the front.

Further, according to another aspect of the present disclosure, the first door driver may further include: a first door motor providing rotational force; a first shaft base protruding from an inner surface of the first door toward the inside of the first upper body, and including a first upper shaft formed on one surface of the first shaft base and a lower shaft formed on the other surface of the first shaft base; a first link having one side fixed to a rotary shaft of the first door motor and the other side to which the first lower shaft is rotatably coupled; and a first door guide disposed on one side of the first shaft base to have a fixed position and including a first guide groove into which the first upper shaft is movably inserted, and the first guide groove may include: a first middle groove adjacent to the first slit and formed with the first upper shaft of the first door positioned at the first position; a first inner groove adjacent to the inner surface of the first inner panel and formed with the first upper shaft of the first door positioned at the second position; and a first outer groove adjacent to the inner surface of the first outer panel and formed with the first upper shaft of the first door positioned at the third position.

Advantageous Effects

Effects of the blower according to the present disclosure are as follows.

According to at least one of embodiments of the present disclosure, it is possible to provide a blower that can blow air using Coanda effect.

According to at least one of embodiments of the present disclosure, it is possible to provide a blower capable of adjusting a flow direction of air passing through a slit to form airflow of direct wind or indirect wind.

According to at least one of embodiments of the present disclosure, it is possible to provide a vane that is movably installed inside a blower to adjust a flow direction of air passing through a slit.

According to at least one of embodiments of the present disclosure, it is possible to provide a door that is movably installed inside a blower to adjust a flow direction of air passing through a slit or open and close the slit.

According to at least one of embodiments of the present disclosure, it is possible to provide a movable vane and door inside a blower while being hidden from a user's gaze.

According to at least one of embodiments of the present disclosure, it is possible to provide various examples of drive mechanisms for moving a vane and a door.

Applicability and an additional range of the present disclosure will be made clear from the following detailed description. However, various changes and modification within the spirit and scope of the present disclosure can be clearly understood by those skilled in the art, so the detailed description and specific embodiments such as preferred embodiments of the present disclosure should be understood only as examples.

DESCRIPTION OF DRAWINGS

FIGS. 4 and 5 are diagrams for describing a vane assembly according to an embodiment of the present disclosure, in which FIG. 4 is a diagram for describing a direct wind, and FIG. 5 is a diagram for describing an indirect wind;

FIGS. 6 and 7 are diagrams for describing a vane assembly according to another embodiment of the present disclosure, in which FIG. 6 is a diagram for describing a direct wind, and FIG. 7 is a diagram for describing an indirect wind;

FIGS. 10 to 12 are diagrams for describing the contents of opening and closing a slit or adjusting a flow direction of air passing through the slit by the door assembly according to the embodiment of the present disclosure, in which FIG. 10 is a diagram for describing the closing of the slit and FIG. 11 is a diagram for describing a direct wind, and FIG. 12 is a diagram for describing an indirect wind.

MODE FOR DISCLOSURE

Figure 1:
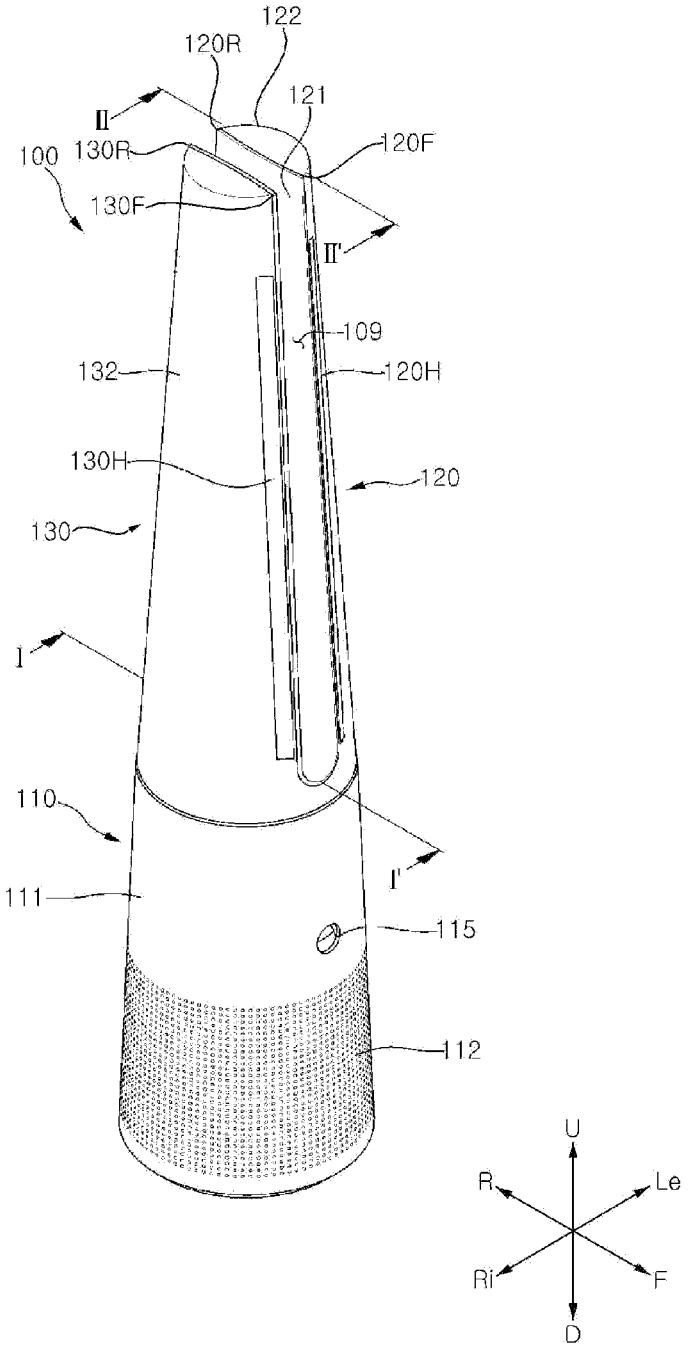
FIG. 1 is a perspective view of a blower according to an embodiment of the present disclosure.

Hereafter, embodiments of the present disclosure will be described in detail with reference to the accompanying drawings and the same or similar components are given the same reference numerals regardless of the numbers of figures and are not repeatedly described.

In the following description, if it is decided that the detailed description of known technologies related to the present disclosure makes the subject matter of the embodiments described herein unclear, the detailed description is omitted. Further, the accompanying drawings are provided only for easy understanding of embodiments disclosed in the specification, the technical spirit disclosed in the specification is not limited by the accompanying drawings, and all changes, equivalents, and replacements should be understood as being included in the spirit and scope of the present disclosure.

Terms including ordinal numbers such as "first", "second", etc., may be used to describe various components, but the components are not to be construed as being limited to the terms. The terms are used only to distinguish one component from another component.

The characters 'U' (up), 'D' (down), 'Le' (left), 'Ri' (right), 'F' (forward), and 'R' (rearward) indicating directions are provided only for convenience of description and the spirit disclosed in the specification is not limited by the characters.

Referring to FIG. 1, a blower 100 may be elongated in the up-down direction. The blower 100 may have a base 102, a lower body 110, and upper bodies 120 and 130.

The base 102 (see FIG. 2) forms the lower surface of the blower 100 and may be placed on the floor of an interior. The base 102 may be formed entirely in a circular plate shape.

The lower body 110 may be disposed over the base 102. The lower body 110 may form the lower portion of the side of the blower 100. The lower body 110 may be formed entirely in a cylinder shape. For example, the diameter of the lower body 110 may decrease upward from the lower portion of the lower body 110. As another example, the diameter of the lower body 110 may be constantly maintained in the up-down direction. A suction hole 112 may be formed to pass through a side of the lower body 110. For example, a plurality of suction holes 112 may be uniformly in the circumferential direction of the lower body 110. Accordingly, air can flow into the blower 100 from the outside through the plurality of suction holes 112.

The upper bodies 120 and 130 may be disposed over the lower body 110. The upper bodies 120 and 130 can provide a channel that communicates with the internal space of the lower body 110.

For example, referring to the figures, the upper bodies 120 and 130 may include a first upper body 120 and a second upper body 130 that are spaced apart from each other.

As another example, the upper bodies 120 and 130 may be provided as a single upper body. In this case, the upper bodies 120 and 130 may be elongated in the up-down direction over the lower body 110 or may be formed in a ring or open ring shape of a circular (elliptical) or track shape. The position of the single upper bodies 120 and 130 with respect to the lower body may be determined in consideration of the shapes of the upper bodies 120 and 130 and the position, the shape, the number, etc. of discharge holes of air formed at the upper bodies 120 and 130.

Hereafter, for brief description, the case in which the upper bodies 120 and 130 include the first upper body 120 and the second upper body 130 is described. Further, description for this can be applied in the same way not only to a case in which the number of the upper bodies 120 and 130 are two, but a case in which one of the upper bodies 120 and 130 is provided as a single upper body.

The first upper body 120 and the second upper body 130 may be disposed over the lower body 110. The first upper body 120 and the second upper body 130 may form the upper portion of the side of the blower 100. The first upper body 120 and the second upper body 130 may be elongated in the up-down direction and may be spaced apart from each other in the left-right direction. A space 109 may be formed between the first upper body 120 and the second upper body 130 and may provide a channel of air. Meanwhile, the space 109 may be referred to as a blowing space, a valley, or a channel. Meanwhile, the first upper body 120 may be referred to as a first tower and the second upper body 130 may be referred to as a second tower.

The first upper body 120 may be spaced left apart from the second upper body 130. The first upper body 120 may be elongated in the up-down direction. The first upper body 120 may include first panels 121 and 122 that form the external shape of the first upper body 120. A first inner panel 121 may define a portion of the boundary of the space 109 while facing the space 109. For example, the surface of the first inner panel 121 may be a curved surface that is convex in a direction facing the space 109 or to the right from the first upper body 120. A first outer panel 122 may be opposite to the first inner panel 121. For example, the surface of the first outer panel 122 may be a curved surface that is convex in a direction opposite to the direction facing the space 109 or to the left from the first upper body 120.

For example, the first inner panel 121 may be elongated in the up-down direction. For example, the first outer panel 122 may extend to be inclined at a predetermined angle (acute angle) in the direction facing the space 109 or to the right with respect to a vertical line extending in the up-down direction.

In this case, the curvature of the first outer panel 122 may be larger than the curvature of the first inner panel 121. Further, the first inner panel 121 may form an edge by meeting with the first outer panel 122. The edge may be provided at a front end 120F and a rear end 120R of the first upper body 120. For example, the front end 120F may extend to be inclined at a predetermined angle (acute angle) rearward with respect to a vertical line extending in the up-down direction. For example, the rear end 120R may be extended and inclined at a predetermined angle (acute angle) forward with respect to a vertical line extending in the up-down direction.

The second upper body 130 may be spaced right apart from the first upper body 120. The second upper body 130 may be elongated in the up-down direction. The second upper body 130 may include second panels 131 and 132 that form the external appearance of the second upper body 130. A second inner panel 131 may define a portion of the boundary of the space 109 while facing the space 109. The surface of the second inner panel 131 may be a curved surface that is convex in a direction facing the space 109 or to the left from the second upper body 130. A second outer panel 132 may be opposite to the second inner panel 131. The surface of the second outer panel 132 may be a curved surface that is convex in a direction opposite to the direction facing the space 109 or to the right from the second upper body 130.

For example, the second inner panel 131 may be elongated in the up-down direction. For example, the second outer panel 132 may be extended and inclined at a predetermined angle (acute angle) in the direction facing the space 109 or to the left with respect to a vertical line extending in the up-down direction.

In this case, the curvature of the second outer panel 132 may be larger than the curvature of the second inner panel 131. Further, the second inner panel 131 may form an edge by meeting with the second outer panel 132. The edge may be provided at a front end 130F and a rear end 130R of the second upper body 130. For example, the front end 130F may be extended and inclined at a predetermined angle (acute angle) rearward with respect to a vertical line extending in the up-down direction. For example, the rear end 130R may be extended and inclined at a predetermined angle (acute angle) forward with respect to a vertical line extending in the up-down direction.

Meanwhile, the first upper body 120 and the second upper body 130 may be left-right symmetric with the space 109 therebetween. Further, the surface of the first outer panel 122 and the surface of the second outer panel 132 may be positioned on a virtual curved surface extending along the outer circumferential surface 111 of the lower body 110. In other words, the surface of the first outer panel 122 and the surface of the second outer panel 132 may smoothly be connected to the outer circumferential surface 111 of the lower body 110. Further, the upper surface of the first upper body 120 and the upper surface of the second upper body 130 may be provided as horizontal surfaces. In this case, the blower 100 may be formed entirely in a truncated cone shape. Accordingly, the possibility that the blower 100 falls down due to external shock may decrease.

A groove (not provided with a reference numeral) may be positioned between the first upper body 120 and the second upper body 130 and may be elongated in the front-rear direction. The groove may be a curved surface that is concave downward. The groove may form a lower boundary of the space 109. Air flows in the lower body 110 by a fan 150 that will be described below may be distributed into the internal space of the first upper body 120 and the internal space of the second upper body 130 with the groove therebetween. Meanwhile, the groove may be referred to as a connection groove or a connection surface.

Meanwhile, a display 115 is provided at the front portion of the lower body 110 and can display operation information of the blower 100 or can provide an interface that can receive instructions of a user. For example, the display may include a touch panel.

Figure 2:
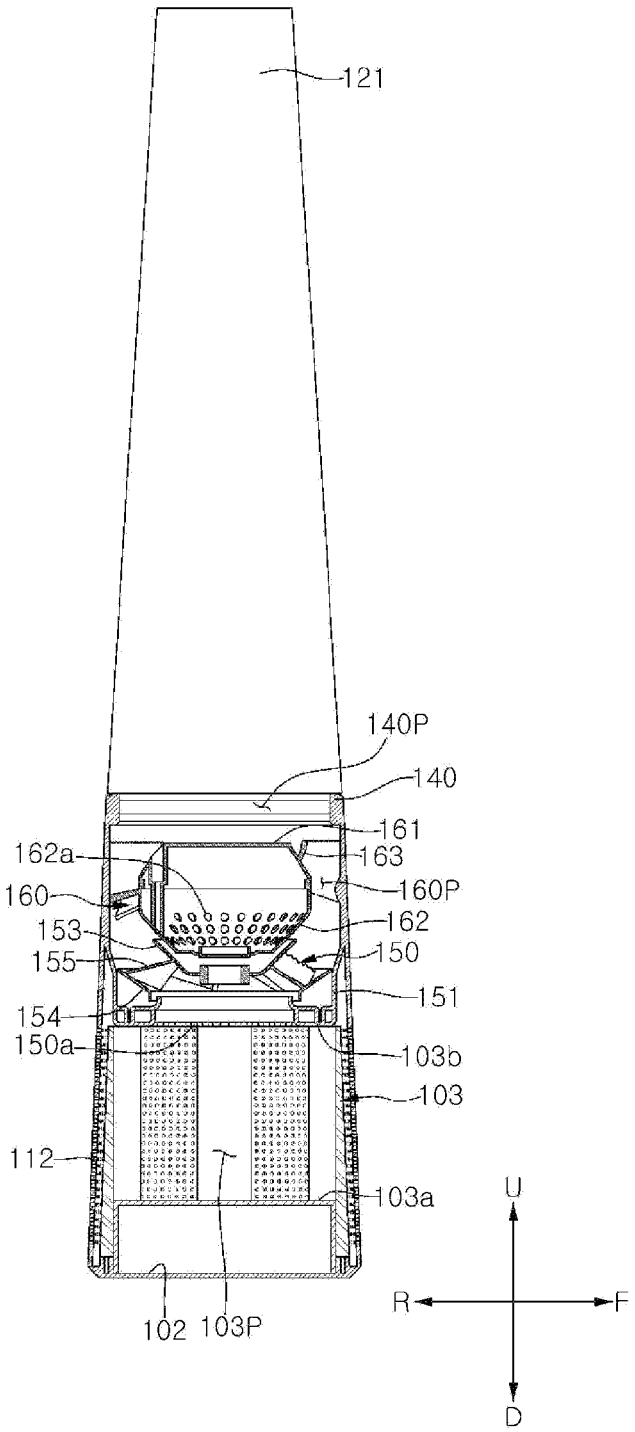
FIG. 2 is a cross-sectional view taken along line I-I' of FIG. 1.

Referring to FIGS. 1 and 2, the lower body 110 may provide an internal space in which a filter 103, a fan 150, and an air guide 160 that will be described below are installed.

The filter 103 may be separably installed in the internal space of the lower body 110. The filter 103 may be formed entirely in a cylinder shape. That is, the filter 103 may include a hole 103P formed to pass through the filter 103 in the up-down direction. In this case, indoor air can flow into the lower body 112 through the suction holes 111 by operation of the fan 150 that will be described below. Further, the indoor air flowing in the lower body 110 may be purified while flowing from the outer circumferential surface to the inner circumferential surface of the filter 103 and may flow upward through the hole 103P.

A filter supporter 103*a* is coupled to the filter 103 from under the filter 103 and can support the filter 103. For example, the filter supporter 103*a* may be formed in a ring shape. For example, the controller may be mounted in the filter supporter 103*a*. A filter frame 103*b* may be coupled to the filter 103 from above the filter 103. The filter frame 103*b* can provide a space in which the filter 103 is mounted.

A grill 150*a* may be disposed between the filter 103 and the fan 150. When the filter 103 is separated from the filter frame 103*b*, the grill 150*a* can prevent fingers of a user from coming into the fan 150.

The fan 150 may be installed in the internal space of the lower body 110 and may be disposed over the filter 103. The fan 150 can generate flow of air that flows into the blower 100 or is discharged from the blower 100 to the outside. The fan 150 may include a fan housing 151, a fan motor (not illustrated), a hub 153, a shroud 154, and a blade 155. Meanwhile, the fan 150 may be referred to as a fan assembly or a fan module.

The fan housing 151 may form the external shape of the fan 150. The fan housing 151 may include a suction port (not provided with a reference numeral) formed to pass through the fan housing 151 in the up-down direction. The suction port is formed at the lower end of the fan housing 151 and may be referred to as a bell mouth.

The fan motor can provide rotational force. The fan motor may be a centrifugal fan or mixed-flow fan motor. The fan motor may be supported by a motor cover 162 that will be described below. In this case, a rotary shaft of the fan motor may be extended downward from the fan motor and may pass through the lower surface of the motor cover 162. The hub 153 is coupled to the rotary shaft and can rotate with the rotary shaft. The shroud 154 may be spaced apart from the hub 153. A plurality of blades 155 may be disposed between the shroud 154 and the hub 153.

Accordingly, when the fan motor is driven, air can flow inside through the suction port in the axial direction of the fan motor (that is, the longitudinal direction of the rotary shaft) and can be discharged upward from the fan motor in the radial direction of the fan motor.

The air guide 160 can provide a channel 160P through which the air discharged from the fan 150 flows. For example, the channel 160P may be an annular channel. The air guide 160 may include a guide body 161, a motor cover 162, and a guide vane 163. Meanwhile, the air guide 160 may be referred to as a diffuser.

The guide body 161 may form the external shape of the air guide 160. The motor cover 162 may be disposed at the middle portion of the air guide 160. For example, the guide body 161 may be formed in a cylinder shape. Further, the motor cover 162 may be formed in a bowl shape. In this case, the annular channel 160P described above may be formed between the guide body 161 and the motor cover 162. The guide vane 163 can guide upward the air provided to the channel 160P from the fan 150. A plurality of guide vanes 163 may be disposed in the annular channel 160P and may be spaced apart from each other in the circumferential direction of the guide body 161. In this case, the plurality of guide vanes 163 each may be extended to the inner circumferential surface of the guide body 161 from the outer surface of the motor cover 161.

A distribution unit 140 may be positioned over the air guide 160 and may be disposed between the lower body 110 and the upper bodies 120 and 130. The distribution unit 140 may provide a channel 140P through which air that has passed through the air guide 160 flows. The air that has passed through the air guide 160 can be distributed to the first upper body 120 and the second upper body 130 through the distribution unit 140. In other words, the air guide 160 guides flow, which flows by the fan 150, to the distribution unit 140 and the distribution unit 140 can guide the air flowing inside from the air guide 160 to the first upper body 120 and the second upper body 130. The groove can form a portion of the outer surface of the distribution unit 140. Meanwhile, the distribution unit may be referred to a middle body, an inner body, or a tower base.

Meanwhile, the first upper body 120 may provide a first channel 120P (see FIG. 4) through which a portion of the air, which has passed through the air guide 160, flows. The first channel 120P may be formed in the internal space of the first upper body 120. The first panels 121 and 122 may form a boundary of the first channel 120P. The second upper body 130 may provide a second channel 130P (see FIG. 4) through which the other of the air, which has passed through the air guide 160, flows. The second channel 120P may be formed in the internal space of the second upper body 130. The second panels 131 and 132 may form a boundary of the first channel 130P. The first channel 120P and the second channel 130P may communicate with the channel 140P of the distribution unit 140 and the channel 160P of the air guide 160.

Referring back to FIG. 1, the first upper body 120 may include a first slit 120H, and the second upper body 130 may include a second slit 130H.

The first slit 120H may be formed to pass through the first panels 121 and 122. For example, the first slit 120H may be formed to pass through the outer panels 121 and 122. The first slit 120H may be adjacent to the front end 120F of the first upper body 120. In other words, the first slit 120H may be formed in a front portion of the first outer panel 122. For example, the first slit 120H may be elongated along the front end 120F of the first upper body 120. As another example, the first slit 120H may be elongated in a direction inclined with respect to the front end 120F of the first upper body 120. A width of the first slit 120H may be smaller than a length of the first slit 120H.

Accordingly, the first slit 120H may discharge air flowing through the first channel 120P (see FIG. 4) of the first upper body 120 to the outside of the first upper body 120.

The second slit 130H may be formed to pass through the second panels 130 and 131. For example, the second slit 130H may be formed to pass through the outer panel 132. The second slit 130H may be adjacent to the front end 130F of the second upper body 130. In other words, the second slit 130H may be formed in a front portion of the second outer panel 132. For example, the second slit 130H may be elongated along the front end 130F of the second upper body 130. As another example, the second slit 130H may be elongated in a direction inclined with respect to the front end 130F of the second upper body 130. A width of the second slit 130H may be smaller than a length of the second slit 130H.

Accordingly, the second slit 130H may discharge air flowing through the second channel 130P (see FIG. 4) of the second upper body 130 to the outside of the first upper body 130.

For example, the first slit 120H and the second slit 130H may be left-right symmetric.

Figure 4:
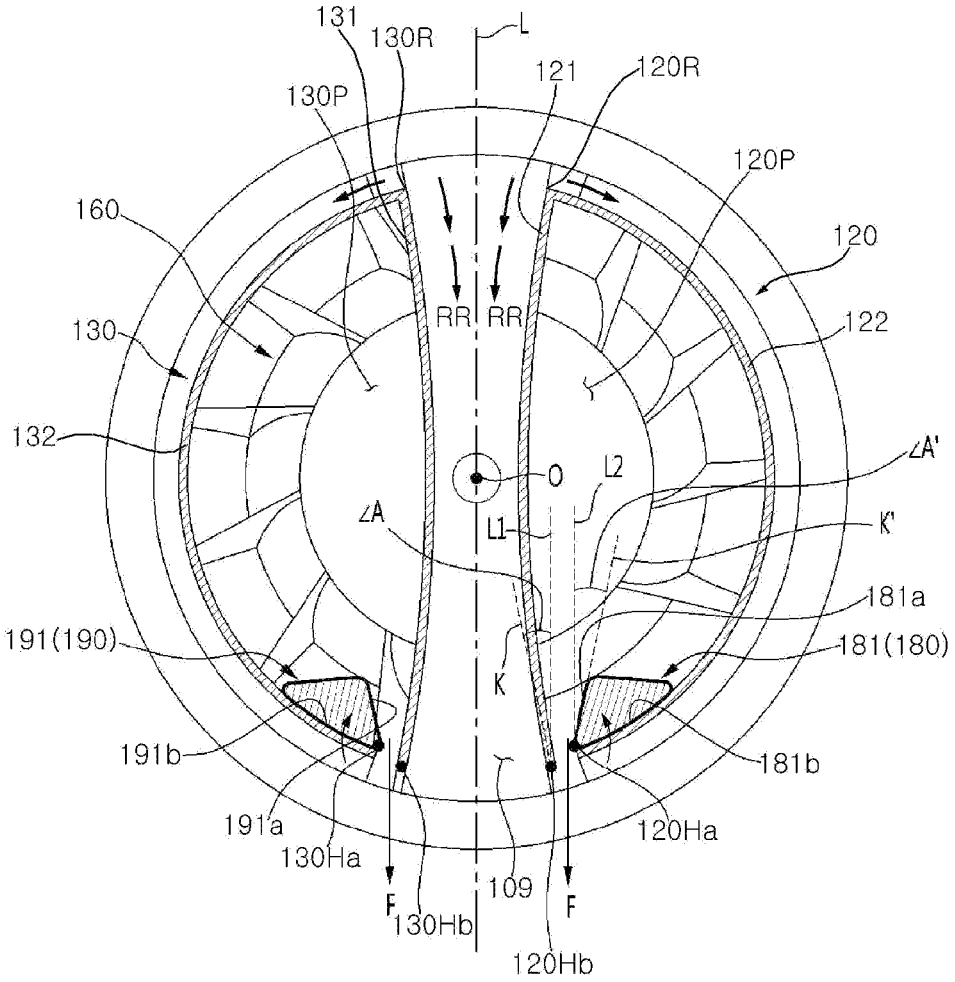

Referring to FIGS. 1 and 4, a central axis O extends in the up-down direction ac the center of the space 109 and the shape of the blower 100 may be symmetric with respect to the central axis O. A reference line L extends in the front-rear direction across the center axis O and a transverse surface of the blower 100 may be left-right symmetric with respect to the reference line L. In other words, the first upper body 120 and the second upper body 130 may be left-right symmetric.

The surface of the first inner panel 121 and the surface of the second inner panel 131 may face each other, and may form left and right boundaries of the space 109. The surface of the first inner panel 121 may be convex to the right toward the central axis O, and the surface of the second inner panel 131 may be convex to the left toward the central axis O. In other words, an interval between the first inner panel 121 and the second inner panel 131 may decrease from the rear to the front and then increase again. Meanwhile, the interval may be referred to as a width of the space 109.

The first interval may be defined as an interval between the front end 120F of the first upper body 120 and the front end 130F of the second upper body 130. The second interval may be defined as an interval between the rear end 120R of the first upper body 120 and the rear end 130R of the second upper body 130. For example, the second interval may be the same as or different from the first interval. A reference interval may be the smallest of the intervals between the surface of the first upper body 120 and the surface of the second upper body 130. For example, the reference interval may be 20 to 30 mm.

For example, in the front-back direction, the interval between the center of the surface of the first upper body 120 and the center of the surface of the second upper body 130 may be the reference interval. As another example, in the front-back direction, the interval between a point positioned in front of the center of the surface of the first upper body 120 and a point positioned in front of the center of the surface of the second upper body 130 may be the reference interval. As another example, in the front-back direction, the interval between a point positioned in back of the center of the surface of the first upper body 120 and a point positioned in back of the center of the surface of the second upper body 130 may be the reference interval.

Accordingly, the width of the space 109 may decrease from the rear portion to the center portion and may increase from the center portion to the front portion.

Figure 3:
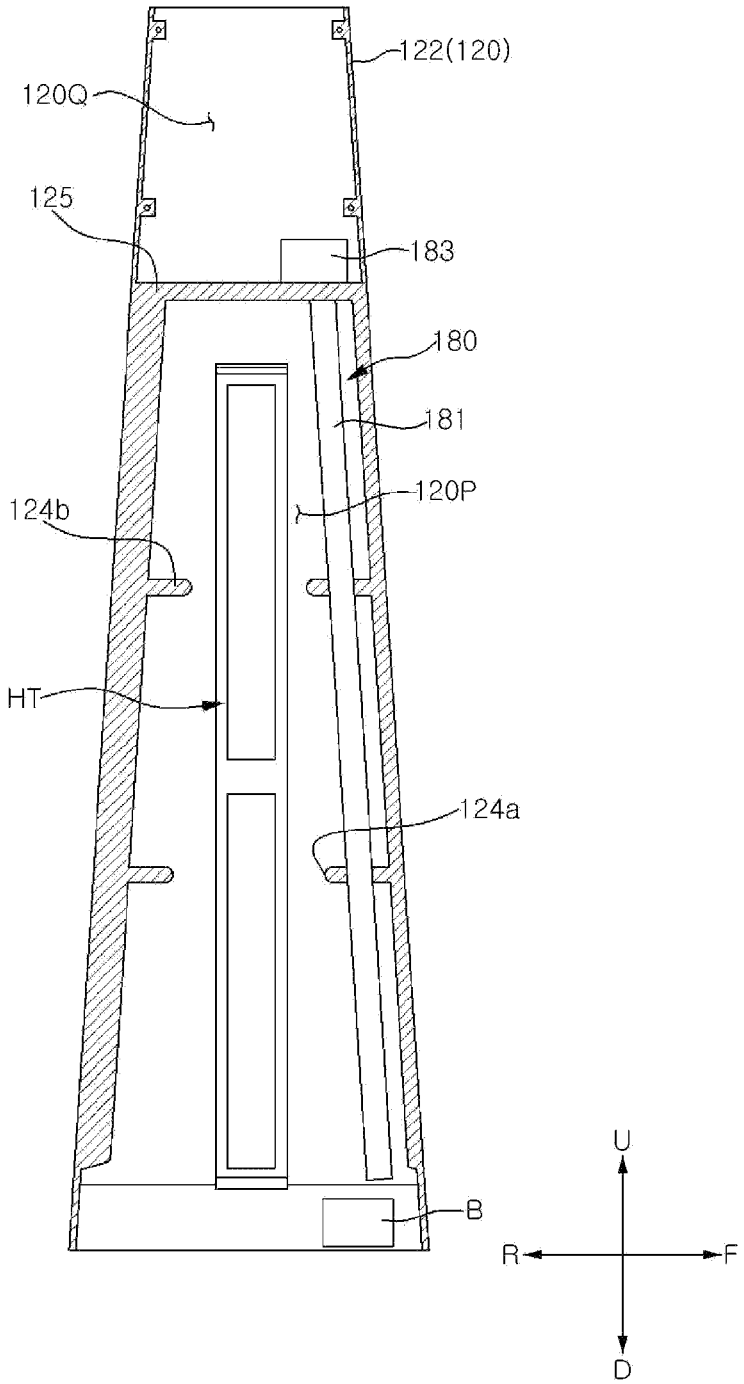
FIG. 3 is a cross-sectional view taken along line II-II' of FIG. 1.

Referring to FIG. 3, first ribs 124*a* and 124*b* may be installed inside the first upper body 120. The first ribs 124*a* and 124*b* may be disposed in the first channel 120P of the first upper body 120. The first ribs 124*a* and 124*b* may be referred to as first horizontal ribs.

The first ribs 124*a* and 124*b* may include the first front rib 124*a* and the first rear rib 124*b* spaced apart from each other in the front-rear direction. The first front rib 124*a* may be disposed in front of the inside of the first upper body 120, and the first rear rib 124*b* may be disposed in back of the inside of the first upper body 120. In other words, the first front rib 124*a* may be positioned in front of the first rear rib 124*b*.

The first front rib 124*a* may protrude rearward from the inner surfaces of the first panels 121 and 122. The first front rib 124*a* may extend from the inner surfaces of the first panels 121 and 122 toward the first slit 120H (refer to FIG. 1). For example, the first front rib 124*a* may include a plurality of first front ribs spaced apart from each other in the longitudinal direction or the up-down direction of the first slit 120H.

The first rear rib 124*b* may protrude forward from the inner surfaces of the first panels 121 and 122. The first rear rib 124*a* may extend from the inner surfaces of the first panels 121 and 122 toward the first slit 120H (see FIG. 1). For example, the first rear rib 124*b* may include a plurality of first rear ribs spaced apart from each other in the longitudinal direction or the up-down direction of the first slit 120H.

Accordingly, the first ribs 124*a* and 124*b* may guide air rising from the first channel 120P to the first slit 120H.

The second rib (not illustrated) may be installed inside the second upper body 130. For example, the second rib may be left-right symmetric to the first ribs 124*a* and 124*b*. Accordingly, the second rib may guide the air rising from the second channel 130P (see FIG. 4) to the second slit 130H (see FIG. 1).

On the other hand, a first partition plate 125 is installed in the inside of the first upper body 120, and may partition an internal space of the first upper body 120 into a lower space positioned below the first partition plate 125 and an upper space 120Q positioned above the partition plate 125. In this case, the first channel 120P may be formed in the lower space. The first partition plate 125 has a substantially semicircular shape and may be disposed above the first upper body 120. For example, a volume of the upper space 120Q may correspond to 10% of the volume of the lower space.

The second partition plate (not illustrated) may be installed inside the second upper body 130. For example, the second partition plate may be left-right symmetric to the first partition plate 125. Accordingly, the second partition plate divides the internal space of the second upper body 130 (see FIG. 1) into the lower space positioned below the second partition plate and the upper space positioned above the second partition plate.

Meanwhile, a first heater HT may be installed in the lower space of the first upper body 120 to heat the air flowing through the first channel 120P during operation. The first heater HT may be spaced apart from the first ribs 124*a* and 124*b*. For example, the first heater HT may be a PTC heater and may include a PTC element and a heat dissipation fin.

A second heater (not illustrated) may be installed in the lower space of the second upper body 130 to heat the air flowing through the second channel 130P (see FIG. 4) during operation. The second heater may be spaced apart from the second rib. For example, the second heater HT may be a PTC heater and may include a PTC element and a heat dissipation fin.

Referring to FIGS. 3 and 4, vane assemblies 180 and 190 may be movably installed inside the upper bodies 120 and 130.

The first vane assembly 180 may be movably installed inside the first upper body 120. The first vane assembly 180 may include a first vane 181 and a first driver 183.

The first vane 181 may be disposed in the first channel 120P and may be adjacent to the first slit 120H. The first vane 181 may be elongated along the first slit 120H. In this case, the first slit 120H may be formed between the first outer edge 120Ha and the first inner edge 120Hb. The first inner edge 120Hb may be the front end 120F of the first upper body 120 or an edge adjacent thereto, and the first outer edge 120Ha may be an edge facing the first inner edge 120Hb of the first outer panel 122. The first inner edge 120Hb may be positioned in front of the first outer edge 120Ha.

In this case, the first vane 181 may be pivotally or rotatably coupled to the inner surface of the first outer panel 122 about the first outer edge 120Ha. In other words, the first outer edge 120Ha may provide a pivot axis or a rotation axis of the first vane 181. Accordingly, compared to the case in which the first vane 181 is pivotably coupled to the inner surface of the first inner panel 121 about the first inner edge 120Hb, it is possible to minimize the flow resistance and noise generation of air passing through the first slit 120H from the first channel 120P. On the other hand, the first vane 181 may have a wedge shape that is elongated as a whole, and may have a blunt vertex.

The first guide surface 181*a* forms one surface of the first vane 181, and may face the inner surface of the first inner panel 121 but be spaced apart from the first inner panel 121. That is, the air in the first channel 120P may be guided to the first slit 120H through a space between the first guide surface 181*a* and the inner surface of the first inner panel 121.

In this case, the first guide surface 181*a* may have a curvature corresponding to the inner surface of the first inner panel 121. For example, the curvature of the first guide surface 181*a* is substantially the same as that of the inner surface of the first inner panel 121, and the curvature of the inner surface of the first inner panel 121 may be substantially the same as that of the surface of the first inner panel 121. Accordingly, it is possible to minimize the flow resistance of air passing through a space between the first guide surface 181*a* and the inner surface of the first inner panel 121.

The first seating surface 181*b* may form the other surface of the first vane 181 and may face the inner surface of the first outer panel 122. The first seating surface 181*b* may have a curvature corresponding to the inner surface of the first outer panel 122. For example, the curvature of the first seating surface 181*b* may be substantially the same as that of the inner surface of the first outer panel 122. In this case, the first seating surface 181*b* may be in close contact with the inner surface of the first outer panel 122. Accordingly, it is possible to minimize a structural factor that may act as the resistance to the air flowing through the first channel 120P.

In this case, the first vane 181 may be pivotably coupled to the first outer edge 120Ha at a point where the first guide surface 181*a* and the first seating surface 181*b* meet. The angle between the first guide surface 181*a* and the first seating surface 181*b* may be an acute angle.

The first driver 183 may provide a driving force to the first vane 181. The first driver 183 may include a first motor (not illustrated) providing a rotational force, and a first shaft (not illustrated) having one side fixed to the rotary shaft of the first motor and the other side fixed to the first vane 181. In this case, the first shaft may be connected to the first outer edge 120Ha and fixed at a point where the first guide surface 181*a* and the first seating surface 181*b* meet. Accordingly, when the first motor is driven, the first vane 181 may rotate or be pivoted about the first outer edge 120Ha by receiving power through the first shaft.

For example, the first driver 183 may be installed in the upper space 120Q positioned above the first partition plate 125. In this case, the first motor may be mounted on the first partition plate 125, and the first shaft may pass through the first partition plate 125 and be connected to the first vane 181.

As another example, the first driver 183 may be installed in a space B positioned below the first channel 120P. However, in order to minimize the air flow resistance, the first driver 183 may be preferably installed in the above-described upper space 120Q.

The second vane assembly 190 may be movably installed inside the second upper body 130. The second vane assembly 190 may include a second vane 191 and a second driver (not illustrated).

The second vane 191 may be disposed in the second channel 130P and may be adjacent to the second slit 130H. The second vane 191 may be elongated along the second slit 130H. In this case, the second slit 130H may be formed between the second outer edge 130Ha and the second inner edge 130Hb. The second inner edge 130Hb may be the front end 130F of the second upper body 130 or an edge adjacent thereto, and the second outer edge 130Ha may be an edge facing the second inner edge 130Hb of the second outer panel 132. The second inner edge 130Hb may be positioned in front of the second outer edge 130Ha.

In this case, the second vane 191 may be pivotally or rotatably coupled to the inner surface of the second outer panel 132 about the first outer edge 130Ha. In other words, the second outer edge 130Ha may provide a pivot axis or a rotation axis of the second vane 191. Accordingly, compared to the case in which the second vane 191 is pivotably coupled to the inner surface of the second inner panel 131 about the second inner edge 130Hb, it is possible to minimize the flow resistance and noise generation of air passing through the second slit 130H from the second channel 130P. On the other hand, the second vane 191 may have a wedge shape that is elongated as a whole, and may have a blunt vertex.

The second guide surface 191*a* forms one surface of the second vane 191, and may face the inner surface of the second inner panel 131 but be spaced apart from the second inner panel 131. That is, the air in the second channel 130P may be guided to the second slit 130H through a space between the second guide surface 191*a* and the inner surface of the second inner panel 130.

In this case, the second guide surface 191*a* may have a curvature corresponding to the inner surface of the second inner panel 131. For example, the curvature of the second guide surface 191*a* is substantially the same as that of the inner surface of the second inner panel 131, and the curvature of the inner surface of the second inner panel 131 may be substantially the same as that of the surface of the second inner panel 131. Accordingly, it is possible to minimize the flow resistance of air passing through a space between the first guide surface 191*a* and the inner surface of the second inner panel 131.

The second seating surface 191*b* may form the other surface of the second vane 191 and may face the inner surface of the second outer panel 132. The second seating surface 191*b* may have a curvature corresponding to the inner surface of the second outer panel 132. For example, the curvature of the second seating surface 191*b* may be substantially the same as that of the inner surface of the second outer panel 132. In this case, the second seating surface 191*b* may be in close contact with the inner surface of the second outer panel 132. Accordingly, it is possible to minimize a structural factor that may act as the resistance to the air flowing through the second channel 130P.

In this case, the second vane 191 may be pivotably coupled to the second outer edge 130Ha at a point where the second guide surface 191*a* and the second seating surface 191*b* meet. The angle between the second guide surface 191*a* and the second seating surface 191*b* may be an acute angle.

The second driver may provide a driving force to the second vane 191. The second driver may include a second motor (not illustrated) providing a rotational force, and a second shaft (not illustrated) having one side fixed to the rotary shaft of the second motor and the other side fixed to the second vane 191. In this case, the second shaft may be connected to the second outer edge 130Ha and fixed at a point where the second guide surface 191*a* and the second seating surface 181*b* meet. Accordingly, when the second motor is driven, the second vane 191 may rotate or be pivoted about the second outer edge 130Ha by receiving power through the second shaft.

For example, the second driver may be installed in an upper space positioned above the second partition plate. In this case, the second motor may be mounted on the second partition plate, and the second shaft may pass through the second partition plate and be connected to the second vane 191.

As another example, the second driver may be installed in a space positioned below the second channel 130P. However, in order to minimize the air flow resistance, the second driver 183 may be preferably installed in the above-described upper space.

Meanwhile, the controller may control the operation of the components of the blower 100 electrically connected to the controller, such as the fan 150, the first vane assembly 180, and the second vane assembly 190 based on a user input.

Figure 5:
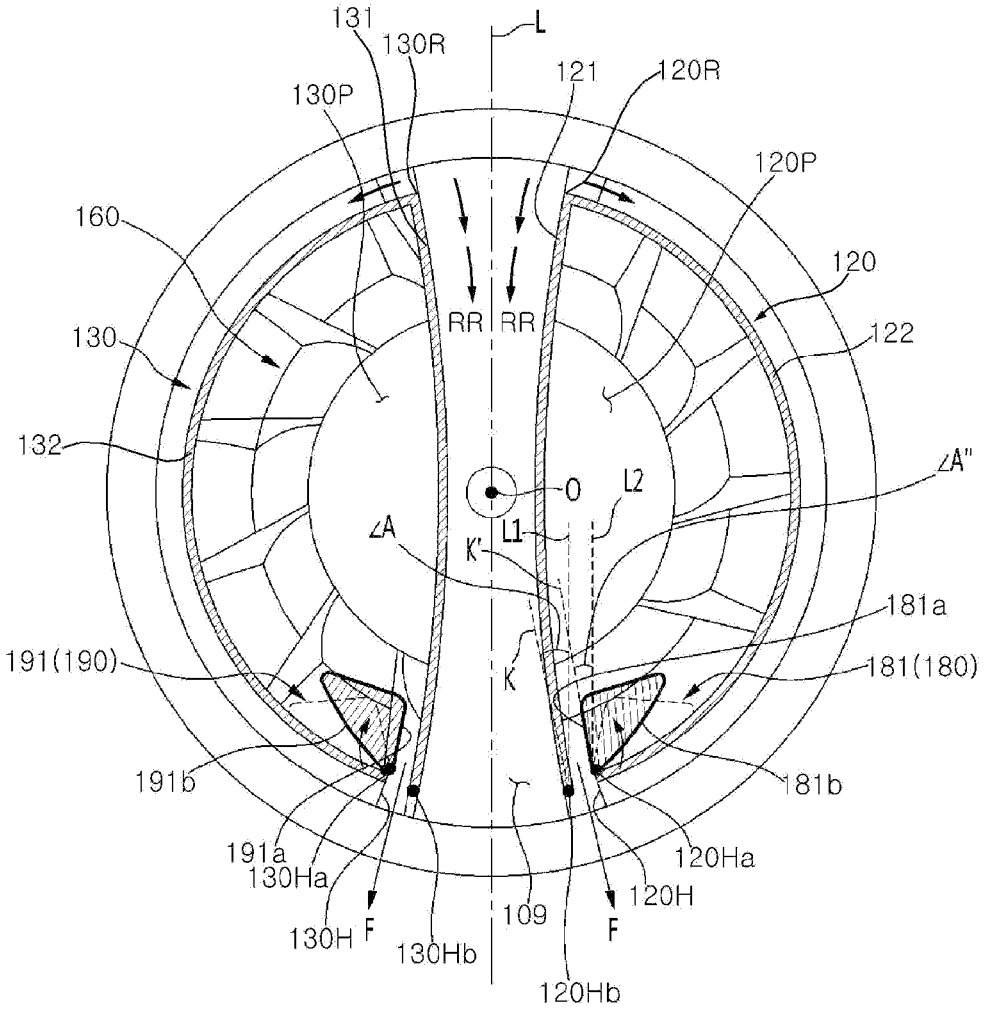

Referring to FIGS. 4 and 5, the first vane assembly 180 and the second vane assembly 190 may be left-right symmetric. That is, the description of the first vane assembly 180 may be equally applied to the second vane assembly 190.

A first reference line L1 may pass through the first inner edge 120Hb and be parallel to the reference line L. A second reference line L2 may pass through the first outer edge 120Ha and be parallel to the reference line L. An angle rotated clockwise with respect to the first and second reference lines L1 and L2 may be described as a positive (+) angle, and an angle rotated counterclockwise may be described as a negative (−) angle. A first angle theta A may be an angle between a tangent line K with respect to the first inner edge 120Ha and the first reference line L1.

Referring to FIG. 4, a second angle theta A' may be an angle between an extension line K' and a second reference line L2 extending along the first guide surface 181*a* in a first state of the first vane 181. Here, the extension line K' may be a tangent line to the center of the first guide surface 181*a* having a predetermined curvature. In the first state, the first seating surface 181*b* may be in close contact with the inner surface of the first outer panel 122. Also, in the first state, a width of the space between the first guide surface 181*a* and the inner surface of the first inner panel 121 may become smaller as it goes downstream.

For example, the second angle theta A' may have the same magnitude as and an opposite direction to the first angle theta A. For example, the second angle theta A' may be +23°, and the first angle theta A may be −23°. In this case, in the first state, the space between the first guide surface 181*a* and the inner surface of the first inner panel 121 may be approximately symmetrical with respect to the center of the space, and the width of the space may become narrower as it goes downstream.

The controller may control the operations of the first vane assembly 180 and the second vane assembly 190 to pivot the first vane 181 and the second vane 191 to the first state. The air in the first channel 120P passes through the space between the first vane 181 and the first inner panel 121 in the first state, and a straight component of the air facing the front may be strengthened. The air in the second channel 130P passes through the space between the second vane 191 and the second inner panel 131 in the first state, and the straight component of the air facing the front may be strengthened. In this case, the air discharged from the first slit 120H and the second slit 130H may be mixed and may flow intensively toward the front of the blower 100. Such airflow may be referred to as a concentrated wind or a direct wind.

In addition, such a flow of air may form airflow in which the air around the upper bodies 120 and 130 is entrained into the space 109 or moves forward along the surfaces of the outer panels 122 and 132 (see RR). In this case, it may be understood that air flows along the surfaces of the upper bodies 120 and 130 due to the Coanda effect. As a result, the blower 100 may provide airflow of an abundant air volume to a user or the like.

Referring to FIG. 5, a third angle theta A" may be an angle between the extension line K' and the second reference line L2 extending along the first guide surface 181*a* in a second state of the first vane 181. Here, the extension line K' may be a tangent line to the center of the first guide surface 181*a* having a predetermined curvature. In the second state, the first seating surface 181*b* may be spaced apart from the inner surface of the first outer panel 122.

For example, the third angle theta A" may have the same magnitude and direction as the first angle theta A. For example, the third angle theta A" and the first angle theta A may be −23°. In this case, in the second state, the width of the space between the first guide surface 181*a* and the inner surface of the first inner panel 121 may be substantially constant.

The controller may control the operations of the first vane assembly 180 and the second vane assembly 190 to pivot the first vane 181 and the second vane 191 to the second state. That is, the first vane 181 in the first state may be pivoted counterclockwise to be in the second state, and the second vane 191 in the first state may be pivoted clockwise to be in the second state.

The air in the first channel 120P passes through the space between the first vane 181 and the first inner panel 121 in the second state, and may be guided to the front left along the curvature of the first guide surface 181*a*. The air in the second channel 120P passes through the space between the first vane 191 and the second inner panel 131 in the second state, and may be guided to the front right along the curvature of the second guide surface 191*a*. In this case, the air discharged from the first slit 120H and the second slit 130H may be mixed, spread widely left and right, and may flow toward the front of the blower 100. Such airflow may be referred to as a diffused wind or an indirect wind.

In addition, such a flow of air may form airflow in which the air around the upper bodies 120 and 130 is entrained into the space 109 or moves forward along the surfaces of the inner panels 122 and 132 or moves forward along the surfaces of the outer panels 122 and 132. In this case, it may be understood that air flows along the surfaces of the upper bodies 120 and 130 due to the Coanda effect. As a result, the blower 100 may provide airflow of an abundant air volume to a user or the like.

For example, the controller synchronizes the operations of the first vane assembly 180 and the second vane assembly 190, so the rotation state of the first vane 181 with respect to the first slit 120H and the rotation state of the second vane 191 with respect to the second slit 130H may be symmetrically adjusted. In this case, the blower 100 may provide the above-described direct wind or indirect wind to a user or the like.

As another example, the controller differently controls the operations of the first vane assembly 180 and the second vane assembly 190, so the rotation state of the first vane 181 with respect to the first slit 120H and the rotation state of the second vane 191 with respect to the second slit 130H may be asymmetrically adjusted. In this case, the blower 100 may provide airflow deflected to the left or right to the user or the like.

Figure 6:
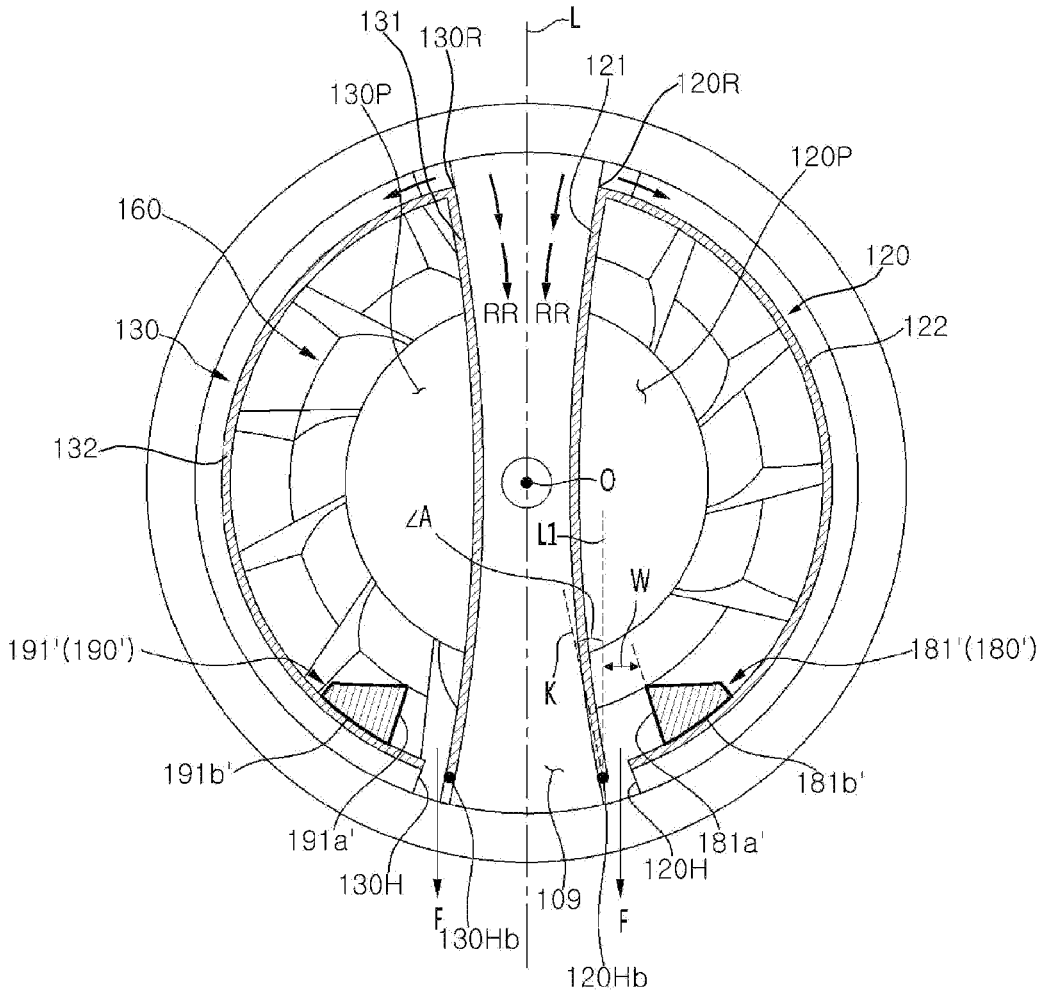
Figure 7:
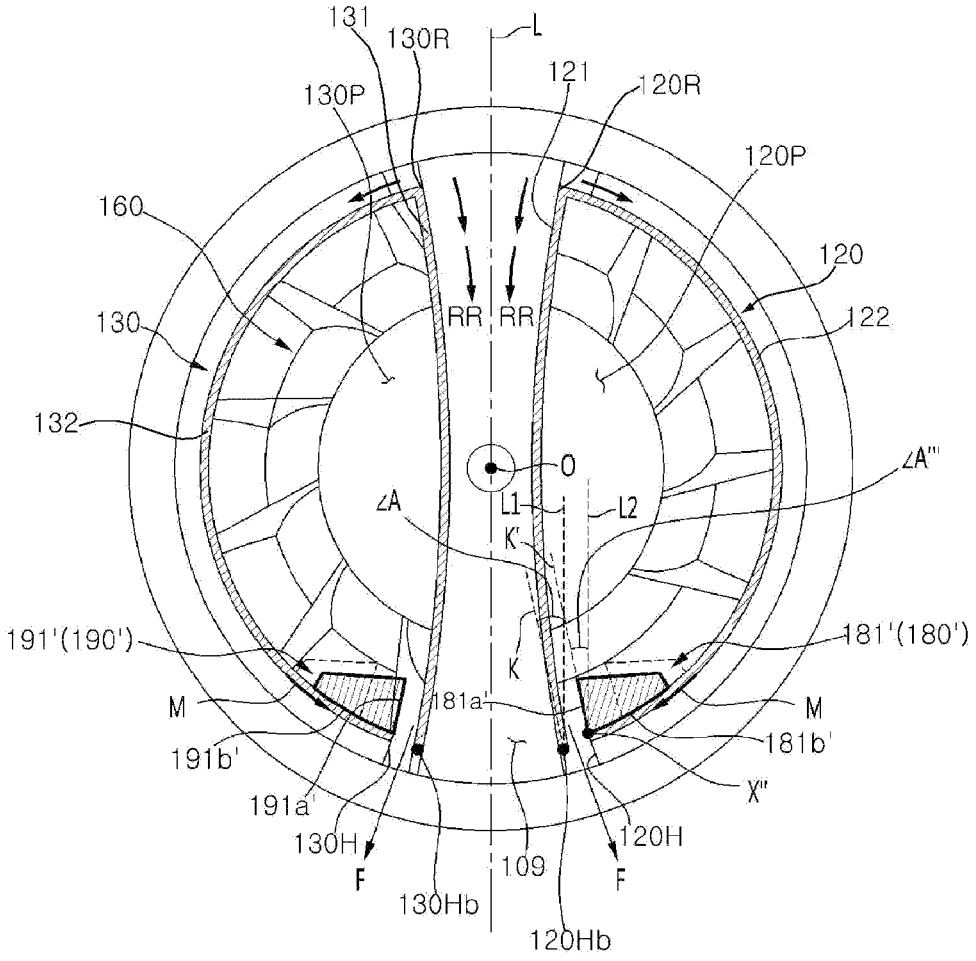

Referring to FIGS. 6 and 7, vane assemblies 180' and 190' may be movably installed inside the upper bodies 120 and 130.

The first vane assembly 180 may be slidably installed inside the first upper body 120. The first vane assembly 180' may include the first vane 181' and the first driver (not illustrated).

The first vane 181' may be disposed in the first channel 120P and may be adjacent to the first slit 120H. The first vane 181' may be elongated along the first slit 120H. The first vane 181' may be slidably coupled to the inner surface of the first outer panel 122. That is, the first vane 181' may slide along the inner surface of the first outer panel 122, and move closer to or away from the end of the first outer panel 122 toward the first slit 120H.

The first guide surface 181*a*' forms one surface of the first vane 181', and may face the inner surface of the first inner panel 121 but be spaced apart from the first inner panel 121. That is, the air in the first channel 120P may be guided to the first slit 120H through a space between the first guide surface 181*a*' and the inner surface of the first inner panel 121.

In this case, the first guide surface 181*a*' may have a curvature corresponding to the inner surface of the first inner panel 121. For example, the curvature of the first guide surface 181*a*' is substantially the same as that of the inner surface of the first inner panel 121, and the curvature of the inner surface of the first inner panel 121 may be substantially the same as that of the surface of the first inner panel 121. Accordingly, it is possible to minimize the flow resistance of air passing through a space between the first guide surface 181*a* and the inner surface of the first inner panel 121.

The first sliding surface 181*b*' may form the other surface of the first vane 181' and may face the inner surface of the first outer panel 122. The first sliding surface 181*b*' may have a curvature corresponding to the inner surface of the first outer panel 122. For example, the curvature of the first sliding surface 181*b*' may be substantially the same as that of the inner surface of the first outer panel 122. In this case, the first sliding surface 181*b*' may slide while being in close contact with the inner surface of the first outer panel 122. Accordingly, it is possible to minimize a structural factor that may act as the resistance to the air flowing through the first channel 120P.

Meanwhile, the angle between the first guide surface 181*a*' and the first sliding surface 181*b*' may be substantially 90°.

The first driver may provide a driving force to the first vane 181'. The first driver may include a first rotary motor providing a rotational force, a first pinion fixed to the rotary shaft of the first rotary motor, and a first rack having one side engaged with a first pinion and the other side fixed to the first vane 181'. In this case, the first rack may extend along the inner surface of the first outer panel 122 to have an arc shape. Accordingly, when the first rotary motor is driven, the first vane 181' may slide on the inner surface of the first outer panel 122 by receiving power through the first pinion and the first rack.

In addition, the first driver may be installed inside the first upper body 120. Preferably, the first driver may be installed in the upper space 120Q positioned above the first partition plate 125 (see FIG. 3).

The second vane assembly 190' may be slidably installed inside the second upper body 130. The second vane assembly 190' may include the second vane 191' and the second driver (not illustrated).

The second vane 191' may be disposed in the second channel 130P and may be adjacent to the second slit 130H. The second vane 191' may be elongated along the second slit 130H. The second vane 191' may be slidably coupled to the inner surface of the second outer panel 132. That is, the second vane 191' may slide along the inner surface of the second outer panel 132, and move closer to or away from the end of the second outer panel 132 toward the second slit 130H.

The second guide surface 191*a*' forms one surface of the second vane 191', and may face the inner surface of the second inner panel 131 but be spaced apart from the second inner panel 131. That is, the air in the second channel 130P may be guided to the second slit 130H through the space between the second guide surface 191*a*' and the inner surface of the second inner panel 130.

In this case, the second guide surface 191*a*' may have a curvature corresponding to the inner surface of the second inner panel 131. For example, the curvature of the second guide surface 191*a*' is substantially the same as that of the inner surface of the second inner panel 131, and the curvature of the inner surface of the second inner panel 131 may be substantially the same as that of the surface of the second inner panel 131. Accordingly, it is possible to minimize the flow resistance of air passing through a space between the first guide surface 191*a* and the inner surface of the second inner panel 131.

The second sliding surface 191*b*' may form the other surface of the second vane 191' and may face the inner surface of the first outer panel 132. The second sliding surface 191*b*' may have a curvature corresponding to the inner surface of the second outer panel 132. For example, the curvature of the second sliding surface 191*b*' may be substantially the same as that of the inner surface of the second outer panel 132. In this case, the second sliding surface 191*b*' may slide while being in close contact with the inner surface of the second outer panel 132. Accordingly, it is possible to minimize a structural factor that may act as the resistance to the air flowing through the second channel 130P.

Meanwhile, the angle between the second guide surface 191*a*' and the second sliding surface 191*b*' may be substantially 90°.

The second driver may provide a driving force to the first vane 191'. The second driver may include a second rotary motor providing a rotational force, a second pinion fixed to the rotary shaft of the second rotary motor, and a second rack having one side engaged with the second pinion and the other side fixed to the second vane 191'. In this case, the second rack may extend along the inner surface of the second outer panel 132 to have an arc shape. Accordingly, when the second rotary motor is driven, the second vane 191' may slide on the inner surface of the second outer panel 132 by receiving power through the second pinion and the second rack.

In addition, the second driver may be installed inside the second upper body 130. Preferably, the second driver may be installed in an upper space positioned above the second partition plate.

Meanwhile, the controller may control the operation of the components of the blower 100 electrically connected to the controller, such as the fan 150, the first vane assembly 180', and the second vane assembly 190' based on the user input.

For example, the first vane assembly 180' and the second vane assembly 190' may be left-right symmetric. That is, the description of the first vane assembly 180' may be equally applied to the second vane assembly 190'.

Referring back to FIG. 6, at the first position of the first vane 181', the first guide surface 181*a*' may be spaced apart from the end facing the first slit 120H of the first outer panel 122.

In this case, an interval W between a rear side of the first guide surface 181*a*' and the first reference line L1 may be greater than the width of the first slit 120H. In other words, a width between the first guide surface 181*a*' and the inner surface of the first inner panel 121 may be greater than the width of the first slit 120H.

The controller may control the operations of the first vane assembly 180' and the second vane assembly 190' to slidably move the first vane 181' and the second vane 191' to the first position. The air in the first channel 120P passes through the space between the first vane 181' and the first inner panel 121' in the first state, and a straight component of the air passing through the space may be strengthened. The air in the second channel 130P passes through the space between the first vane 191' and the first inner panel 130' at the first position, and the straight component of the air passing through the space may be strengthened. In this case, the air discharged from the first slit 120H and the second slit 130H may be mixed and may flow intensively toward the front of the blower 100. Such airflow may be referred to as a concentrated wind or a direct wind.

In addition, such a flow of air may form airflow in which the air around the upper bodies 120 and 130 is entrained into the space 109 or moves forward along the surfaces of the outer panels 122 and 132 (see RR). In this case, it may be understood that air flows along the surfaces of the upper bodies 120 and 130 due to the Coanda effect. As a result, the blower 100 may provide the airflow of an abundant air volume to a user or the like.

Referring back to FIG. 7, at the first position of the first vane 181', the first guide surface 181*a*' may be positioned or aligned at the end facing the first slit 120H of the first outer panel 122.

In this case, in the second state, the width of the space between the first guide surface 181*a*' and the inner surface of the first inner panel 121' may be substantially constant.

That is, the first vane 181 in the first state may be pivoted counterclockwise to be in the second state, and the second vane 191 in the first state may be pivoted clockwise to be in the second state.

The controller may control the operations of the first vane assembly 180' and the second vane assembly 190' to slidably move the first vane 181' and the second vane 191' to the first position. That is, the first vane 181' positioned at the first position slides toward the end of the first outer panel 122 to move to the second position, and the second vane 191' positioned at the first position may move to the second position by sliding toward the end of the second outer panel 132.

The air in the first channel 120P passes through the space between the first vane 181' and the first inner panel 121 at the second position, and may be guided to the front left along the curvature of the first guide surface 181*a*'. The air in the second channel 130P passes through the space between the second vane 191' and the second inner panel 131 in the second state, and may be guided to the front right along the curvature of the second guide surface 191*a*'. In this case, the air discharged from the first slit 120H and the second slit 130H may be mixed, spread widely left and right, and may flow toward the front of the blower 100'. Such airflow may be referred to as a diffused wind or an indirect wind.

In addition, such a flow of air may form airflow in which the air around the upper bodies 120 and 130 is entrained into the space 109 or moves forward along the surfaces of the inner panels 122 and 132 or moves forward along the surfaces of the outer panels 122 and 132. In this case, it may be understood that air flows along the surfaces of the upper bodies 120 and 130 due to the Coanda effect. As a result, the blower 100 may provide the airflow of an abundant air volume to a user or the like.

For example, the controller synchronizes the operations of the first vane assembly 180' and the second vane assembly 190', so the position of the first vane 181' with respect to the first slit 120H and the position of the second vane 191' with respect to the second slit 130H may be symmetrically adjusted. In this case, the blower 100' may provide the above-described direct wind or indirect wind to a user or the like.

As another example, the controller differently controls the operations of the first vane assembly 180' and the second vane assembly 190', so the position of the first vane 181' with respect to the first slit 120H and the position of the second vane 191' with respect to the second slit 130H may be symmetrically adjusted. In this case, the blower 100' may provide airflow deflected to the left or right to the user or the like.

Figure 8:
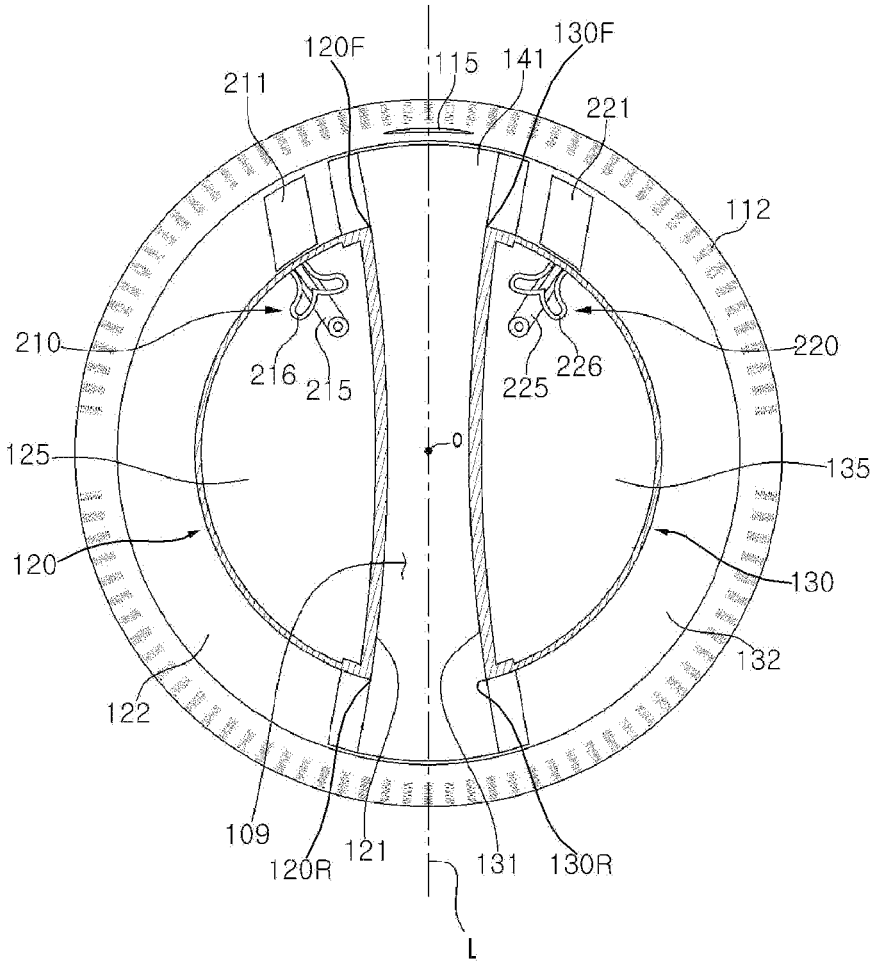
FIGS. 8 and 9 are diagrams for describing a door assembly according to the embodiment of the present disclosure.
Figure 9:
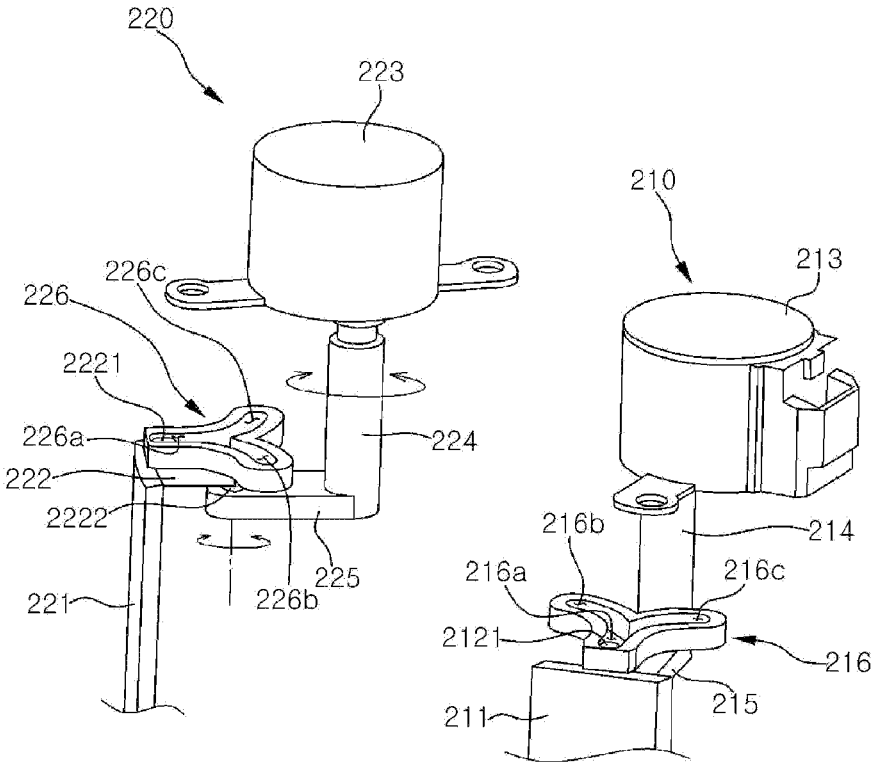

Referring to FIGS. 8 and 9, the first door 211 is movably installed on the first upper body 120 to open and close the first slit 120H. The second door 221 may be movably installed on the second upper body 130 to open and close the second slit 130H. Meanwhile, the first door 211 may be referred to as a first vane, a first damper, or a first board, and the second door 221 may be referred to as a second vane, a second damper, or a second board. For example, the first door 211 and the second door 221 may be left-right symmetric.

The first door 211 may be elongated along the first slit 120H. The area of the first door 211 may be the same as the size of the first slit 120H. The first door 211 may be inserted into or separated from the first slit 120H. The curvature of the surface of the first door 211 may be substantially the same as the curvature of the first outer panel 122. Accordingly, when the first slit 120H is closed, the surface of the first door 211 may be smoothly connected to the surface of the first outer panel 122.

The second door 221 may be elongated along the second slit 130H. The area of the second door 221 may be the same as the size of the second slit 130H. The second door 221 may be inserted into or separated from the second slit 130H. The curvature of the surface of the first door 221 may be substantially the same as that of the second outer panel 132. Accordingly, when the second slit 130H is closed, the surface of the second door 221 may be smoothly connected to the surface of the second outer panel 132.

The first door assembly 210 may include a first door 211 and a first door driver providing power to the first door 211. The first door driver may include a first shaft base 212, first door shafts 2121 and 2122, a first door motor 213, first links 214 and 215, and a first door guide 216.

The first shaft base 212 may protrude toward the inside of the first upper body 120 from the upper end or lower end of the first door 211. The longitudinal direction of the first shaft base 212 may cross or orthogonal to that of the first door 211. The length of the first shaft base 212 may be smaller than that of the first door 211. The width of the first shaft base 212 may be smaller than that of the first door 211.

The first door shafts 2121 and 2122 may be adjacent to the upper end or the lower end of the first door 211. The first upper shaft 2121 may be formed on the upper surface of the first shaft base 212, and the first lower shaft 2122 may be formed on the lower surface of the first shaft base 212. For example, the first shaft base 212 may have one end coupled to the upper end of the first door 211 and the other end opposite to the one end. In this case, the first upper shaft 2121 is closer to the one end than the other end of the first shaft base 212, and the first lower shaft 2122 is closer to the other end than the one end of the first shaft base 212.

The first door motor 213 may provide a rotational force. The first door motor 213 may be a step motor. For example, the first door motor 213 may be installed on the first partition plate 125. The rotary shaft of the first door motor 213 may extend downward from the first door motor 213.

One side of the first links 214 and 215 may be fixed to the rotary shaft of the first door motor 213, and the other side of the first links 214 and 215 may be coupled to the first lower shaft 2122. The first links 214 and 215 may be formed in an "L" shape as a whole.

For example, the first links 214 and 215 may include a first upper part 214 and a first lower part 215. The first upper part 214 may be disposed below the first door motor 213, and may extend vertically to pass through the first partition plate 125. An upper end of the first upper part 214 may be fixed to a rotary shaft of the first door motor 213. The first lower part 215 may extend from the lower end of the first upper part 214 toward the first door 211. The longitudinal direction of the first lower part 215 may cross or orthogonal to that of the first upper part 214. An end of the first lower part 215 facing the first door 211 may be spaced apart from the first door 211. In addition, the first lower shaft 2122 may be rotatably coupled to the end of the first lower part 215.

The first door guide 216 may be positioned above the first shaft base 212. The first door guide 216 may be fixed to the lower surface of the first partition plate 125. The first guide grooves 216*a*, 216*b*, and 216*c* may be formed by vertically passing through the first door guide 216, or may be formed while being depressed upward from the lower surface of the first door guide 216. In this case, the first upper shaft 2121 may be movably inserted into the first guide grooves 216*a*, 216*b*, and 216*c*.

The first guide grooves 216*a*, 216*b*, and 216*c* may be formed in three different directions from the center of the first door guide 216. The first guide grooves 216*a*, 216*b*, and 216*c* may have a triangular boomerang shape. For example, the first door guide 216 may have a "Y" shape corresponding to the shape of the first guide grooves 216*a*, 216*b*, and 216*c*. As another example, the first door guide 216 may be formed in a triangular or wedge shape having the first guide grooves 216*a*, 216*b*, and 216*c* inside thereof.

The first middle groove 216*a* may be positioned at first vertices of the first guide grooves 216*a*, 216*b*, and 216*c*, and may be adjacent to the first slit 120H. The first inner groove 216*b* may be positioned at second vertices of the first guide grooves 216*a*, 216*b*, and 216*c*, and may be adjacent to the inner surface of the first inner panel 121. The first outer groove 216*b* may be positioned at third vertices of the first guide grooves 216*a*, 216*b*, and 216*c*, and may be adjacent to the inner surface of the first inner panel 122. Also, a groove connecting the first middle groove 216*a* and the first inner groove 216*b* may be convex toward the center of the first door guide 216. Also, the groove connecting the first middle groove 216*a* and the first outer groove 216*b* may be convex toward the center of the first door guide 216. For example, the first inner groove 216*b* and the first outer groove 216*c* may be symmetrical with respect to the first middle groove 216*a*.

The second door assembly 220 may include a second door 221 and a second door driver providing power to the first door 221. The second door driver may include a second shaft base 222, second door shafts 2221 and 2222, a second door motor 223, second links 224 and 225, and a second door guide 226.

The second shaft base 222 may protrude toward the inside of the second upper body 130 from the upper end or lower end of the first door 221. The longitudinal direction of the second shaft base 222 may cross or orthogonal to that of the first door 221. The length of the second shaft base 222 may be smaller than that of the first door 221. The width of the second shaft base 222 may be smaller than that of the second door 221.

The second door shafts 2221 and 2222 may be adjacent to the upper end or the lower end of the second door 221. The second upper shaft 2221 may be formed on the upper surface of the first shaft base 212, and the second lower shaft 2222 may be formed on the lower surface of the second shaft base 212. For example, the second shaft base 222 may have one end coupled to the upper end of the second door 221 and the other end opposite to the one end. In this case, the second upper shaft 2221 may be closer to the one end than the other end of the second shaft base 222, and the second lower shaft 2222 may be closer to the other end than the one end of the second shaft base 222.

The second door motor 223 may provide a rotational force. The second door motor 223 may be a step motor. For example, the second door motor 223 may be installed on the second partition plate 135. The rotary shaft of the second door motor 223 may extend downward from the second door motor 223.

One side of the second links 224 and 225 may be fixed to the rotary shaft of the second door motor 223, and the other side of the second links 224 and 225 may be coupled to the second lower shaft 2222. The second links 224 and 225 may be formed in an "L" shape as a whole.

For example, the second links 224 and 225 may include a second upper part 224 and a second lower part 225. The second upper part 224 may be disposed below the second door motor 223, and may extend vertically to pass through the second partition plate 135. An upper end of the second upper part 224 may be fixed to a rotary shaft of the second door motor 223. The second lower part 225 may extend from the lower end of the second upper part 224 toward the second door 221. The longitudinal direction of the second lower part 225 may cross or orthogonal to that of the second upper part 224. An end of the second lower part 225 facing the second door 221 may be spaced apart from the second door 221. In addition, the second lower shaft 2222 may be rotatably coupled to the end of the second lower part 225.

The second door guide 226 may be positioned above the second shaft base 222. The second door guide 226 may be fixed to the lower surface of the second partition plate 135. The second guide grooves 226*a*, 226*b*, and 226*c* may be formed by vertically passing through the second door guide 226, or may be formed while being depressed upward from the lower surface of the first door guide 226. In this case, the second upper shaft 2221 may be movably inserted into the second guide grooves 226*a*, 226*b*, and 226*c*.

The second guide grooves 226*a*, 226*b*, and 226*c* may be formed in three different directions from the center of the second door guide 226. The second guide grooves 226*a*, 226*b*, and 226*c* may have a triangular boomerang shape. For example, the second door guide 226 may have a "Y" shape corresponding to the shape of the second guide grooves 226*a*, 226*b*, and 226*c*. As another example, the second door guide 226 may be formed in a triangular or wedge shape having the second guide grooves 226*a*, 226*b*, and 226*c* inside thereof.

The second middle groove 226*a* may be positioned at first vertices of the second guide grooves 226*a*, 226*b*, and 226*c*, and may be adjacent to the second slit 130H. The second inner groove 216*b* may be positioned at second vertices of the second guide grooves 226*a*, 226*b*, and 226*c*, and may be adjacent to the inner surface of the second inner panel 131. The second outer groove 226*c* may be positioned at third vertices of the second guide grooves 226*a*, 226*b*, and 226*c*, and may be adjacent to the inner surface of the second outer panel 132. Also, the groove connecting the second middle groove 226*a* and the second inner groove 226*b* may be convex toward the center of the second door guide 226. Also, the groove connecting the second middle groove 226*a* and the second outer groove 216*b* may be convex toward the center of the second door guide 226. For example, the second inner groove 226*b* and the second outer groove 226*c* may be symmetrical with respect to the second middle groove 226*a*.

For example, the first door assembly 210 and the second door assembly 220 may be left-right symmetric with respect to the reference line L. That is, the description of the first door assembly 210 may be equally applied to the second door assembly 220.

Meanwhile, the controller may control operations of components of a blower 100" electrically connected to the controller, such as the fan 150, the first door assembly 210, and the second door assembly 220 based on the user input.

Figure 10:
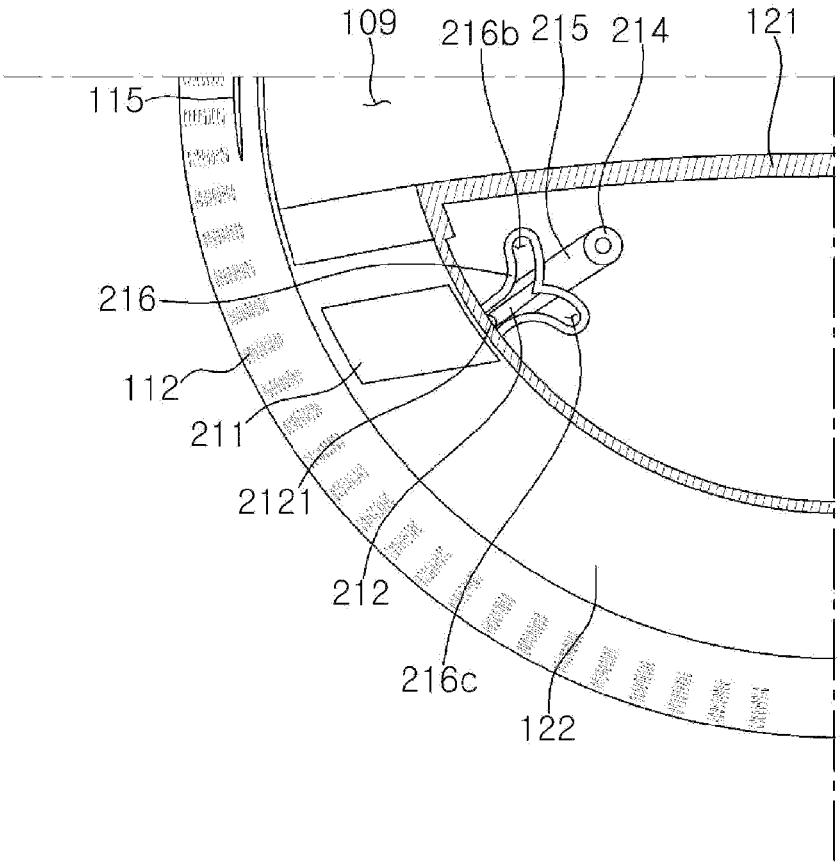

Referring to FIGS. 9 and 10, the first door 211 may close the first slit 120H at the first position. In this case, the surface of the first door 211 may be smoothly connected to the surface of the first outer panel 122.

The controller may control the operations of the first door assembly 210 and the second door assembly 220 to move the first door 211 and the second door 221 to the first position. In this case, the first upper shaft 2121 may be positioned in the first middle groove 216*a*, and the second upper shaft 2221 may be positioned in the second middle groove 226*a*.

Accordingly, the air discharge through the first slit 120H and the second slit 130H may be blocked.

Figure 11:
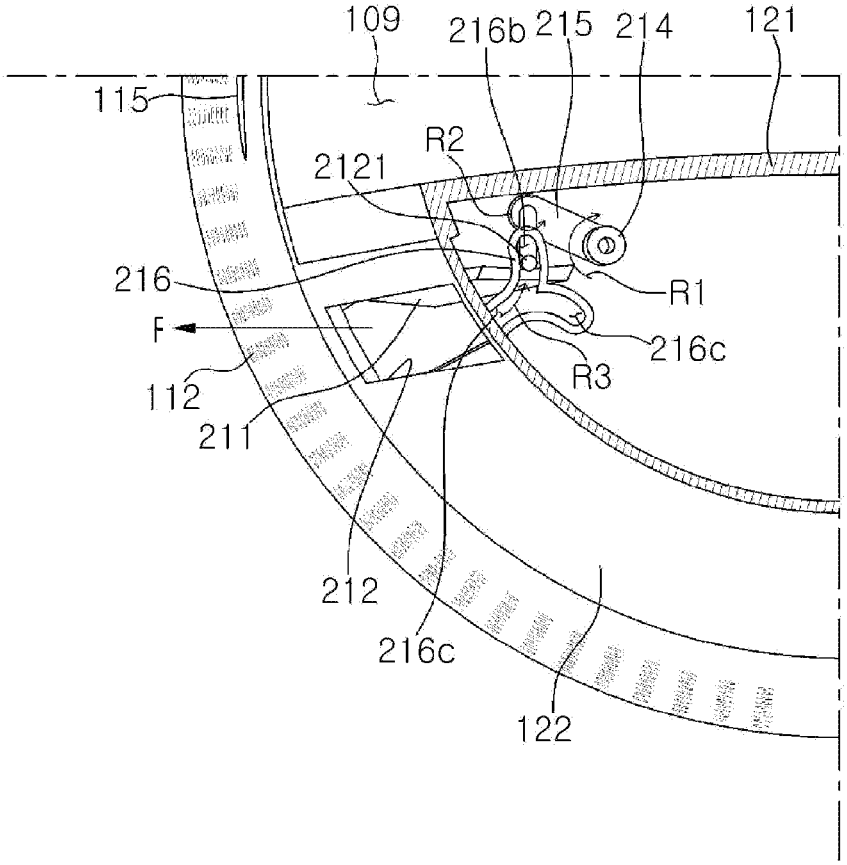

Referring to FIGS. 9 and 11, the first door 211 may open the first slit 120H at the second position.

Specifically, when the rotary shaft of the first door motor 213 rotates in a first rotation direction R1, the first links 214 and 215 may also rotate in the first rotation direction R1. In this case, the first shaft base 212 may rotate in a second rotation direction R2 opposite to the first rotation direction R1 about the first lower shaft 2122. Accordingly, the first upper shaft 2121 and the first door 211 may rotate and move from the first middle groove 216*a* toward the first inner groove 216*b* (see R3). Here, the first rotation direction R1 may be a clockwise direction, and the second rotation direction R2 may be a counterclockwise direction.

In this case, the surface of the first door 211 may be positioned inside the first upper body 120 and disposed in a direction crossing the first inner edge (not provided with a reference numeral) of the first slit 120H. In other words, the front end of the surface of the first door 211 may be adjacent to the first inner edge. Here, the first inner edge may define a right boundary of the first slit 120H. In addition, the distance between the front end of the surface of the first door 211 and the reference line L may be smaller than the distance between the rear end of the surface of the first door 211 and the reference line L.

Accordingly, the flow direction of the air passing through the first slit 120H may be formed to be closer to the reference line L.

The controller may control the operations of the first door assembly 210 and the second door assembly 220 to move the first door 211 and the second door 221 to the second position. In this case, the first upper shaft 2121 may be positioned in the first inner groove 216*b*, and the second upper shaft 2221 may be positioned in the second inner groove 226*a*.

In this case, the air discharged from the first slit 120H and the second slit 130H may be mixed and may flow intensively toward the front of the blower 100". Such airflow may be referred to as a concentrated wind or a direct wind.

In addition, such a flow of air may form airflow in which the air around the upper bodies 120 and 130 is entrained into the space 109 or moves forward along the surfaces of the outer panels 122 and 132. In this case, it may be understood that air flows along the surfaces of the upper bodies 120 and 130 due to the Coanda effect. As a result, the blower 100" may provide airflow of an abundant air volume to a user or the like.

Figure 12:
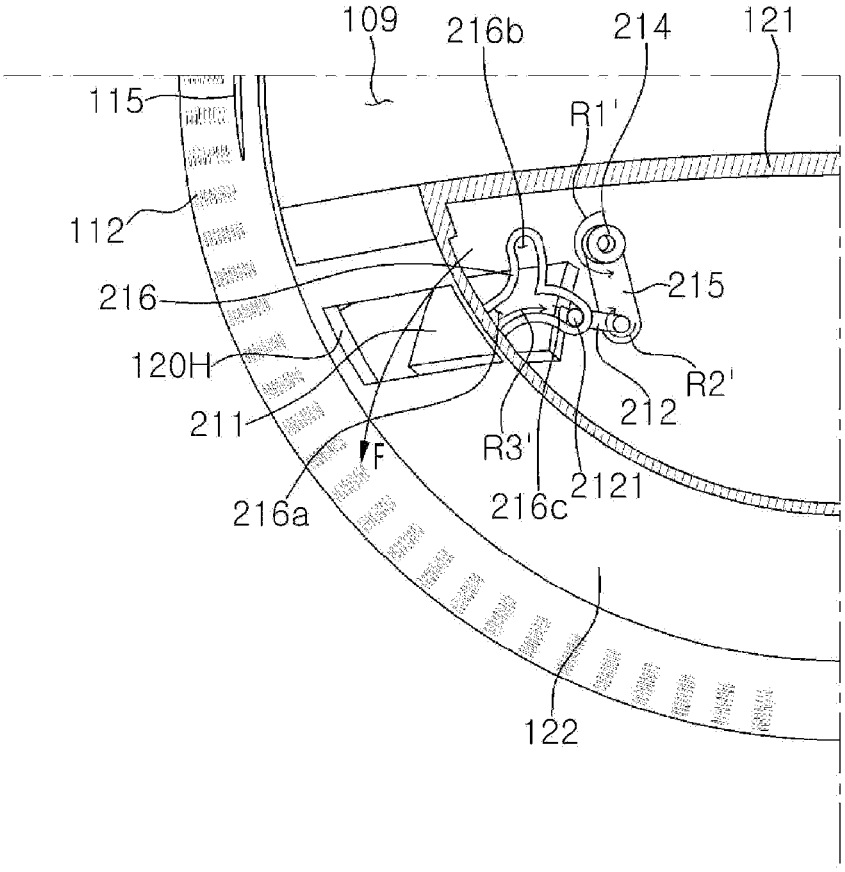

Referring to FIGS. 9 and 12, the first door 211 may open the first slit 120H at the third position.

Specifically, when the rotary shaft of the first door motor 213 rotates in a first rotation direction R1', the first links 214 and 215 may also rotate in the first rotation direction R1'. In this case, the first shaft base 212 may rotate in a second rotation direction R2' opposite to the first rotation direction R1' about the first lower shaft 2122. Accordingly, the first upper shaft 2121 and the first door 211 may rotate and move from the first middle groove 216*a* toward the first outer groove 216*b* (see R3'). Here, the first rotation direction R1' may be a clockwise direction, and the second rotation direction R2' may be a counterclockwise direction.

In this case, the surface of the first door 211 may be positioned inside the first upper body 120 and disposed in a direction crossing the first inner edge (not provided with a reference numeral) of the first slit 120H. In other words, the front end of the surface of the first door 211 may be adjacent to the first outer edge. Here, the first outer edge may define a left boundary of the first slit 120H and may be positioned behind the first inner edge. In addition, the distance between the front end of the surface of the first door 211 and the reference line L may be smaller than the distance between the rear end of the surface of the first door 211 and the reference line L. Meanwhile, the front end of the surface of the first door 211 at the third position may be the rear end of the surface of the first door 211 at the second position.

Accordingly, the flow direction of the air passing through the first slit 120H may be formed along the surface of the first door 211 to be relatively far from the reference line L.

The controller may control the operations of the first door assembly 210 and the second door assembly 220 to move the first door 211 and the second door 221 to the third position. In this case, the first upper shaft 2121 may be positioned in the first outer groove 216*c*, and the second upper shaft 2221 may be positioned in the second inner groove 226*c*.

In this case, the air discharged from the first slit 120H and the second slit 130H is mixed, spreads left and right, and may flow toward the front of the blower 100" (see F of FIG. 12). Such airflow may be referred to as a diffused wind or an indirect wind.

In addition, such a flow of air may form airflow in which the air around the upper bodies 120 and 130 is entrained into the space 109 or moves forward along the surfaces of the inner panels 122 and 132 or moves forward along the surfaces of the outer panels 122 and 132. In this case, it may be understood that air flows along the surfaces of the upper bodies 120 and 130 due to the Coanda effect. As a result, the blower 100" may provide the airflow of the abundant air volume to a user or the like.

Certain embodiments or other embodiments of the disclosure described above are not mutually exclusive or distinct from each other. Any or all elements of the embodiments of the disclosure described above may be combined or combined with each other in configuration or function.

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A blower, comprising:

a fan generating flow of air;

a lower body providing an internal space in which the fan is installed, and having a suction hole through which air passes;

an upper body being an upper body, which is installed over the lower body and forms a channel that communicates with the internal space of the lower body, and having a space formed through the upper body in a front-rear direction;

a slit formed to pass through the upper body and discharging air flowing through the channel of the upper body to an outside of the upper body; and a vane or a door movably installed inside the upper body, and adjusting a flow direction of the air passing through the slit.

2. The blower of claim 1, wherein the vane is installed pivotally or slidably inside the upper body, and a space between the vane and an inner surface of the upper body varies in response to rotation or sliding of the vane, and guides the air flowing through the channel of the upper body to the slit.

3. The blower of claim 1, wherein the door is rotatably and movably installed inside the upper body to open and close the slit or to adjust the flow direction of air passing through the slit.

4. The blower of claim 1, wherein the upper body further includes:

a first upper body forming a first channel that communicates with the internal space of the lower body; and a second upper body spaced apart from the first upper body and forming a second channel that communicates with the internal space of the lower body, a space is formed between the first upper body and the second upper body, and the slit includes:

a first slit formed to pass through the first upper body; and a second slit formed to pass through the second upper body.

5. The blower of claim 4, wherein the first upper body includes:

a first inner panel facing the space; and, a first outer panel facing the first inner panel and having the first slit formed therein, and the second upper body includes:

a second inner panel facing the space; and a second outer panel facing the first inner panel and having the first slit formed therein.

6. The blower of claim 5, wherein the first inner panel is in contact with the first outer panel to form a front end and a rear end of the first upper body, the second inner panel is in contact with the second outer panel to form a front end and a rear end of the second upper body, the first slit is adjacent to the front end of the first upper body, and the second slit is adjacent to the front end of the second upper body.

7. The blower of claim 5, wherein the first upper body is spaced left apart from the second upper body, a surface of the first inner panel is convex to the right, a surface of the first outer panel is convex to the right, a surface of the second inner panel is convex to the left, a surface of the second outer panel is convex to the right, a curvature of the surface of the first outer panel is greater than that of the surface of the first inner panel, and a curvature of the surface of the second outer panel is greater than that of the surface of the second inner panel.

8. The blower of claim 5, further comprising:

a first rib installed inside the first upper body to guide the air in the first channel to the first slit; and a second rib installed inside the second upper body to guide the air in the second channel to the second slit.

9. The blower of claim 5, wherein the vane further includes:

a first vane disposed inside the first upper body and adjacent to the first slit; and a second vane disposed on the inside of the second upper body and adjacent to the second slit, and the blower further includes:

a first vane assembly installed inside the first upper body and having the first vane and a first driver providing power to the first vane;

a second vane assembly installed inside the second upper body and having the second vane and a second driver providing power to the second vane; and a controller electrically connected to the first vane assembly and the second vane assembly to control operations of the first vane assembly and the second vane assembly.

10. The blower of claim 9, wherein the first vane assembly and the second vane assembly are left-right symmetric.

11. The blower of claim 9, wherein the first slit is formed between a first inner edge adjacent to a front end of the first upper body and a first outer edge facing the first inner edge of the first outer panel, and the first vane is elongated along the first slit and is movable in a direction closer to or away from an inner surface of the first inner panel.

12. The blower of claim 11, wherein the first vane includes:

a first guide surface forming one surface of the first vane and facing the inner surface of the first inner panel but spaced apart from the first inner panel; and a first seating surface forming the other surface of the first vane and facing an inner surface of the first outer panel, and the first vane is pivotably coupled to the first outer edge at a point where the first guide surface and the first seating surface meet.

13. The blower of claim 12, wherein the first inner panel is convex in a direction facing the space, the first guide surface has a shape corresponding to the inner surface of the first inner panel, the first seating surface has a shape corresponding to the inner surface of the first outer panel, and the first vane receives power from the first driver and pivots about the first outer edge to be closer to or away from the inner surface of the first inner panel.

14. The blower of claim 11, wherein the first vane includes:

a first guide surface forming one surface of the first vane and facing the inner surface of the first inner panel but spaced apart from the first inner panel; and a first sliding surface forming the other surface of the first vane and facing the inner surface of the first outer panel, and the first vane is slidable in a direction closer to or away from the first outer edge.

15. The blower of claim 14, wherein the first inner panel is convex in a direction facing the space, the first guide surface has a shape corresponding to the inner surface of the first inner panel, the first sliding surface has a shape corresponding to the inner surface of the first outer panel, and the first vane receives power from the first driver and slides along the inner surface of the first outer panel to be closer to or away from the inner surface of the first inner panel.

16. The blower of claim 5, wherein the door further includes:

a first door rotatably and movably installed on the first upper body and opening and closing the first slit; and a second door rotatably and movably installed on the second upper body and opening and closing the second slit, and the blower further includes:

a first door assembly installed inside the first upper body and having the first door and a first door driver providing power to the first door; and a second door assembly installed inside the second upper body and having the second door and a second door driver providing power to the second door; and a controller electrically connected to the first door assembly and the second door assembly and controlling operations of the first door assembly and the second door assembly.

17. The blower of claim 16, wherein the first door assembly and the second door assembly are left-right symmetric.

18. The blower of claim 16, wherein the first slit is formed between a first inner edge adjacent to a front end of the first upper body and a first outer edge facing the first inner edge of the first outer panel, the first door is elongated along the first slit, and an area of the first door is larger than a size of the first slit.

19. The blower of claim 18, wherein the first door is disposed in parallel with the first outer panel to close the first slit, at a first position, disposed inside the first upper body to open the first slit and disposed in a direction crossing the first inner edge, at a second position, and disposed inside the first upper body to open the first slit and disposed in a direction crossing the first outer edge, at a third position, the first door positioned at the second position is disposed closer to the first inner panel toward the front, and the first door positioned at the third position is disposed closer to the first outer panel toward the front.

20. The blower of claim 19, wherein the first door driver further includes:

a first door motor providing rotational force;

a first shaft base protruding from an inner surface of the first door toward the inside of the first upper body, and including a first upper shaft formed on one surface of the first shaft base and a lower shaft formed on the other surface of the first shaft base;

a first link having one side fixed to a rotary shaft of the first door motor and the other side to which the first lower shaft is rotatably coupled; and a first door guide disposed on one side of the first shaft base to have a fixed position and including a first guide groove into which the first upper shaft is movably inserted, and the first guide groove includes:

a first middle groove adjacent to the first slit and formed with the first upper shaft of the first door positioned at the first position;

a first inner groove adjacent to the inner surface of the first inner panel and formed with the first upper shaft of the first door positioned at the second position; and a first outer groove adjacent to the inner surface of the first outer panel and formed with the first upper shaft of the first door positioned at the third position.

* * * * *